US005360069A

United States Patent [19]

Schmuck et al.

[11] Patent Number: 5,360,069

[45] Date of Patent: Nov. 1, 1994

[54] FAILSAFE LINER INSTALLATION ASSEMBLY AND METHOD

[75] Inventors: Phillip W. Schmuck, New Waverly; Steven R. Hayter, Houston; James R. Zachman, The Woodlands; John V. Salerni, Kingwood, all of Tex.

[73] Assignee: Baker Hughes Incorporated, Houston, Tex.

[21] Appl. No.: 40,130

[22] Filed: Mar. 30, 1993

[51] Int. Cl.[5] ..... E21B 43/04

[52] U.S. Cl. ..... 166/383; 166/387; 166/193

[58] Field of Search ..... 166/383, 387, 193, 278, 166/51

[56] References Cited

U.S. PATENT DOCUMENTS

| | | | |
|---|---|---|---|
| 4,161,216 | 7/1979 | Amancharla | 166/193 |
| 4,372,384 | 2/1983 | Kinney | 166/278 |
| 4,540,051 | 9/1985 | Schmuck et al. | 166/278 |
| 4,541,486 | 9/1985 | Wetzel et al. | 166/297 |
| 4,856,591 | 8/1989 | Donovan et al. | 166/278 |
| 4,858,691 | 8/1989 | Ilfrey et al. | 166/278 |
| 4,915,172 | 4/1990 | Donovan et al. | 166/278 |
| 4,951,750 | 10/1990 | Wetzel | 166/278 |

*Primary Examiner*—William P. Neuder

*Attorney, Agent, or Firm*—Rosenblatt & Associates

[57] ABSTRACT

An apparatus and method for installation of oil field tubulars, such as liners, is disclosed. The invention allows positioning of a liner with assurances that rotational forces or pressure applied within or outside the work string will actuate the packer or the release assembly above the packer. Specific deliberate steps must be taken in order that rotational forces or applied pressure actuate the packer setting assembly and the disconnect assembly. The preliminary deliberate steps which must be taken also incorporate a feature of converting a gravel pack crossover assembly from the flow through mode to the crossover mode to facilitate the gravel placement. Circulation or reverse circulation to promote removal debris upon insertion of the assembly without fear of actuation of the packer and disconnect assembly are also provided. A retention system to ensure the continuing functioning of the crossover assembly in the crossover mode is provided such that if differential forces on the sealing member are reduced to a very low value, the retaining mechanism acts to keep the sealing member against the seat to ensure continuing viability of operation of the crossover assembly during the placement of gravel. The unlocking is accomplished with a series of steps which invoice reuse of an auxiliary sealing member in at least two positions in the wellbore.

48 Claims, 26 Drawing Sheets

FAILSAFE LINER INSTALLATION ASSEMBLY AND METHOD

FIELD OF THE INVENTION

The field of the invention relates to an apparatus and method for installation of oil field tubular goods such as well liners.

BACKGROUND OF THE INVENTION

In the past, subsequent to drilling the wellbore, a liner is frequently installed prior to the onset of regular production. Typically, a procedure commonly known in the industry as gravel packing is performed. An assembly composed of a work string, a running tool assembly, a disconnect assembly, a packer assembly, and a liner assembly, is put together at the surface and lowered into the wellbore. If a gravel pack procedure is contemplated, a gravel pack crossover assembly is installed usually between the packer assembly and the liner assembly. In the past, after positioning the liner assembly at the desired location in the wellbore, the packer is set and the work string must be disconnected from the packer to be removed from the wellbore. Prior designs have involved disconnect assemblies that require rotation which allows a thread to disengage. Other mechanical connections that can be undone by rotation alone or in combination with a push or a pull have also been used in the past as the mode of disconnection between the disconnect assembly and the packer. Alternative designs have used pressure buildup which in turn creates a series of mechanical movements to facilitate disconnection between the disconnect assembly and the packer.

During routine operations with the liner systems described above, the entire assembly would be placed in the wellbore. The running tool would be actuated, thereby setting the packer. Thereafter, the disconnect assembly would be actuated to release the tubing string from the packer. At that time, if the particular operation called for it, a gravel pack procedure would be done. At the conclusion of a gravel pack procedure, the running tool assembly and the internal sections of the gravel pack crossover assembly are withdrawn, leaving the packer and liner assembly in the wellbore.

The prior systems for liner installation suffered from several drawbacks. One important drawback is a limited ability to rotate. The reason is that rotation could result in premature actuation of the disconnect assembly or setting the packer. Sometimes rotation is required, such as if the assembly is stuck in the wellbore. In those situations, experience has shown that many times the assembly can be unstuck if there is a capability to rotate. Previous designs have used shear pins to prevent premature actuation of the disconnect assembly. However, shear pins have a predetermined ability to resist shear forces up to the failure point. Sometimes forces larger than the capacity of the shear pins are required to liberate the assembly from a stuck position. As wellbores get more and more deviated or if they contain doglegs, the probability of sticking the assembly is increased. What has been lacking is a locking mechanism which ensures that the disconnect assembly will not be actuated upon the application of rotational force which may at times be necessary to further advance the assembly if it becomes stuck.

Another drawback of prior designs that actuate or disconnect hydraulically is that there are occasions, when running in the liner assembly, that the debris in the wellbore accumulates within the central flowpath or outside of the assembly. Experience has shown that to remove such accumulated debris within the central bore or on the outside of the assembly, pressure can be applied from the surface either through the annulus or through the central bore to circulate or reverse circulate this debris out of the wellbore. The debris needs to be removed so that subsequent procedures can take place. Unfortunately, if the assembly is hydraulically actuated, pressure buildup in trying to move accumulated debris, either within the central bore or in the annulus, can create sufficient forces to cause premature actuation of the running tool assembly and/or premature actuation of the disconnect assembly. Accordingly, what is needed is a tool and method of the present invention which prevents actuation, regardless of the amount of pressure buildup. This is done by constructing the apparatus in such a manner that deliberate steps must be taken at the surface in order for the pressure applied for debris removal to actuate either the running tool assembly, i.e., the packer, or the disconnect assembly adjacent the packer. One of several ways to do this is to provide a pressure-balanced tool assembly which accordingly cannot be actuated until a pressure-type plug device or other device is inserted into the assembly. Similarly, the disconnect assembly can be locked positively, using mechanical or hydraulic mechanisms which will not actuate on pressure buildup until several preliminary steps are deliberately taken. Without these preliminary steps, any application of pressure in the apparatus or outside of it will not actuate the setting assembly for the packer or the disconnect assembly adjacent the packer.

It should be noted that prior designs suffered from the problem of inadvertent actuation, regardless of whether the applied pressure was in the annulus or in the central flowpath. Some prior designs were set up to actuate on increasing annulus pressure.

Another drawback of the prior art has been that when using a gravel pack crossover assembly, circulation was not possible to the bottom of the liner assembly because the presence of the crossover assembly provided a path of least resistance immediately downhole from the packer assembly. The apparatus and method of the present invention provide a convertible gravel pack crossover assembly. The apparatus and method have been developed such that the necessary preliminary steps of defeating the various locks and setting the packer have incorporated a feature of converting the crossover sub into the crossover mode. Additional features have been added such that the mechanism which accomplishes this conversion from straight through to the crossover mode is physically retained in a sealing relationship against the circulation forces which act on it, which would in some instances tend to make the mechanism come away from the sealing surface. Accordingly, the apparatus and method have included a retaining feature for the sealing member which accomplishes the conversion to crossover flow. The apparatus and method of the present invention have the flexibility to allow circulation or reverse circulation to remove debris and changeover of a convertible gravel pack crossover assembly to permit deposition of the gravel outside the liner and a return flow through the crossover member out the annulus onto the surface.

One of the objects of this invention is to allow security for the operator to know that application of twisting forces or hydraulic pressure within the liner assembly or in the annulus outside will not inadvertently actuate the release mechanism or set the packer prematurely.

SUMMARY OF THE INVENTION

An apparatus and method for installation of oil field tubulars, such as liners, is disclosed. The invention allows positioning of a liner with assurances that rotational forces or pressure applied within or outside the work string will not actuate the packer or the release assembly above the packer. Specific deliberate steps must be taken in order that rotational forces or applied pressure actuate the packer setting assembly and the disconnect assembly. The preliminary deliberate steps which must be taken also incorporate a feature of convening a gravel pack crossover assembly from the flow through mode to the crossover mode to facilitate the gravel placement. Circulation or reverse circulation to promote removal of debris upon insertion of the assembly without fear of actuation of the packer and disconnect assembly are also provided. A retention system to ensure the continuing functioning of the crossover assembly in the crossover mode is provided such that if differential forces on the sealing member are reduced to a very low value, the retaining mechanism acts to keep the sealing member against the seat to ensure continuing viability of operation of the crossover assembly during the placement of gravel. The unlocking is accomplished with a series of steps which involve reuse of an auxiliary sealing member in at least two positions in the wellbore.

DETAILED DESCRIPTION OF THE DRAWINGS

DETAILED DESCRIPTION OF THE PREFERRED EMBODIMENT

Figure 1A:
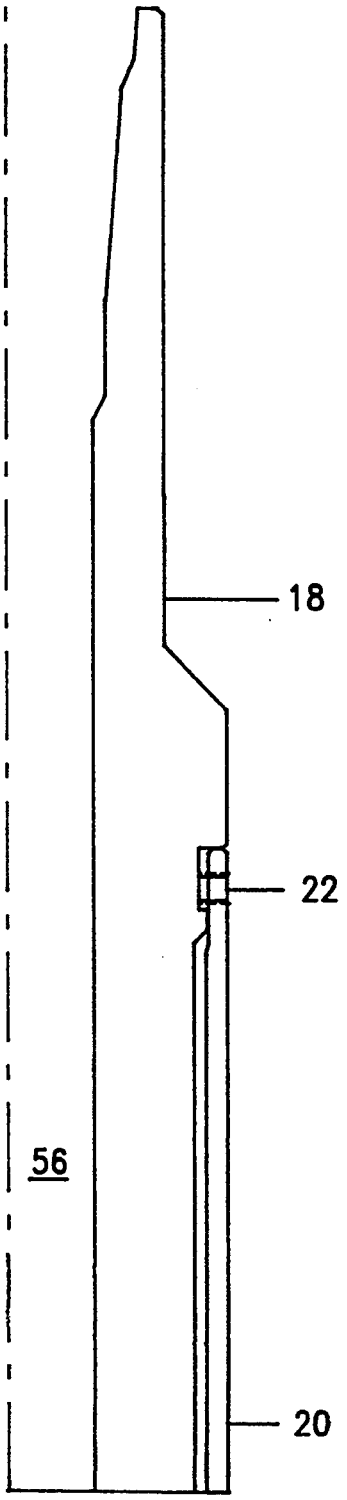
FIGS. 1A–1H is an elevational part section view of the running tool disconnect and packer assembly of the present invention in the run-in position.
Figure 2A:
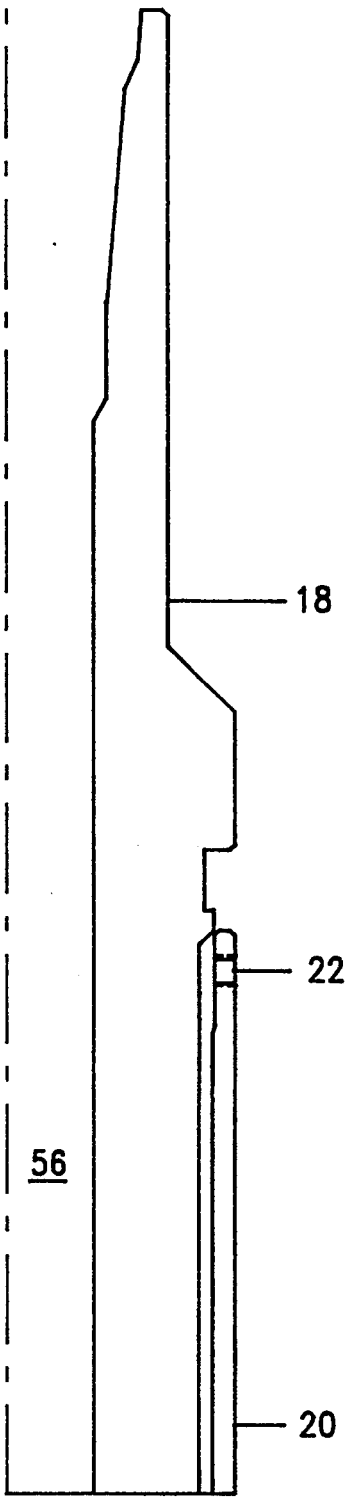
FIGS. 2A–2H is the view of FIG. 1, with the apparatus in the beginning setting position.
Figure 1B:
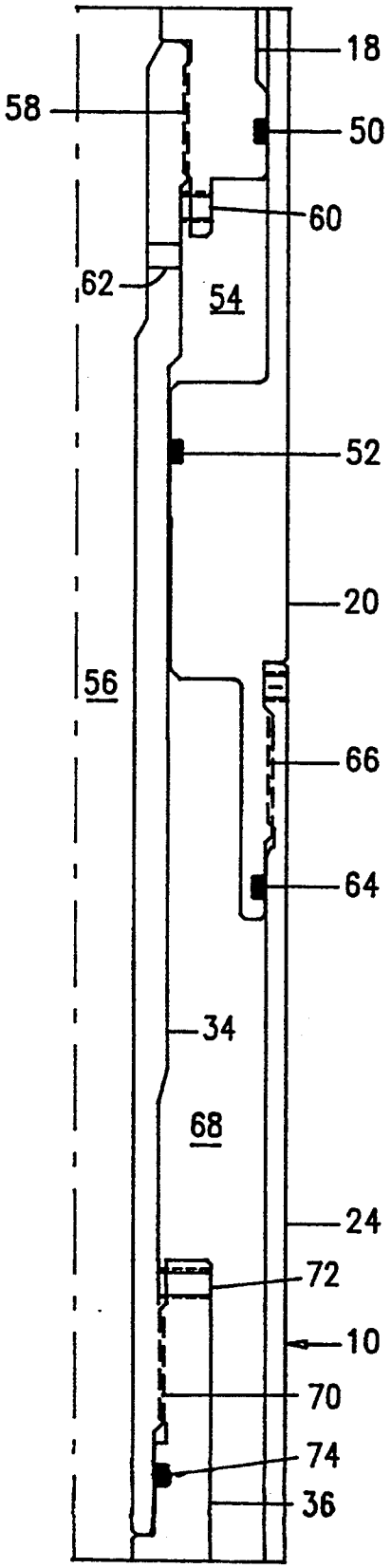
Figure 2B:
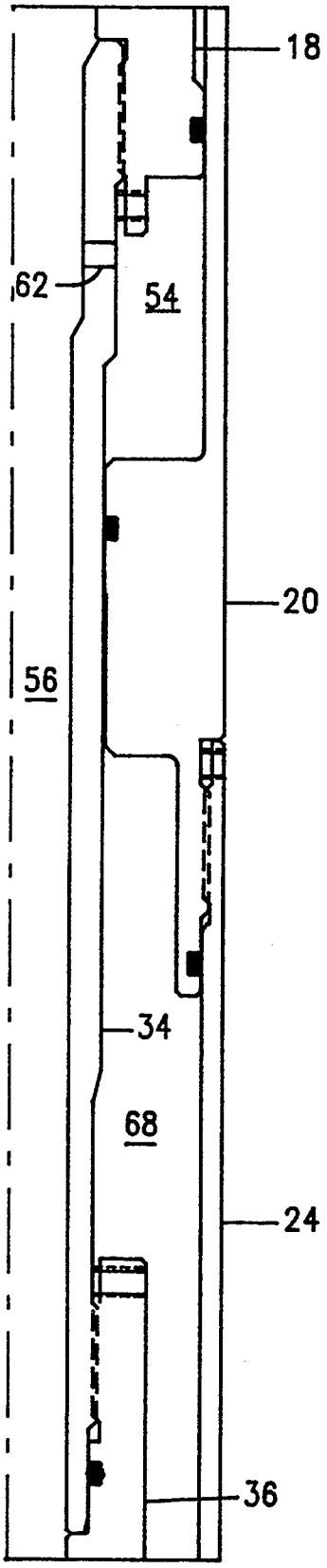
Figure 1C:
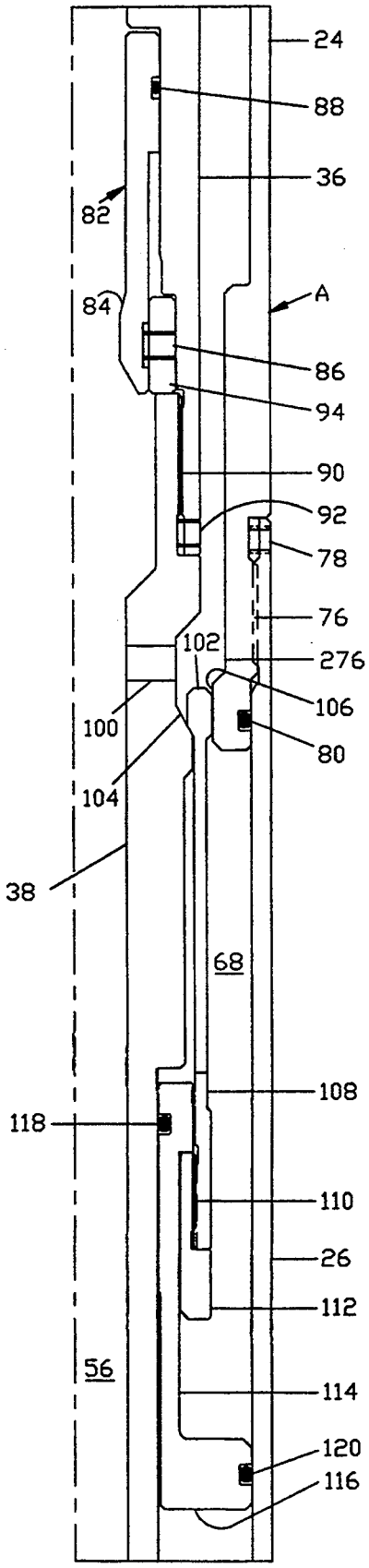
Figure 2C:
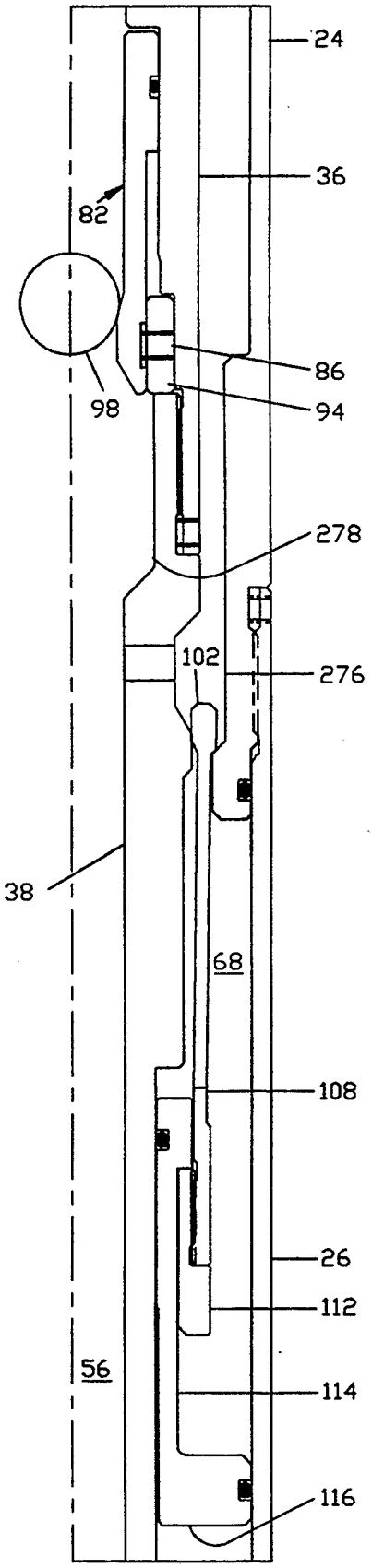
Figure 1D:
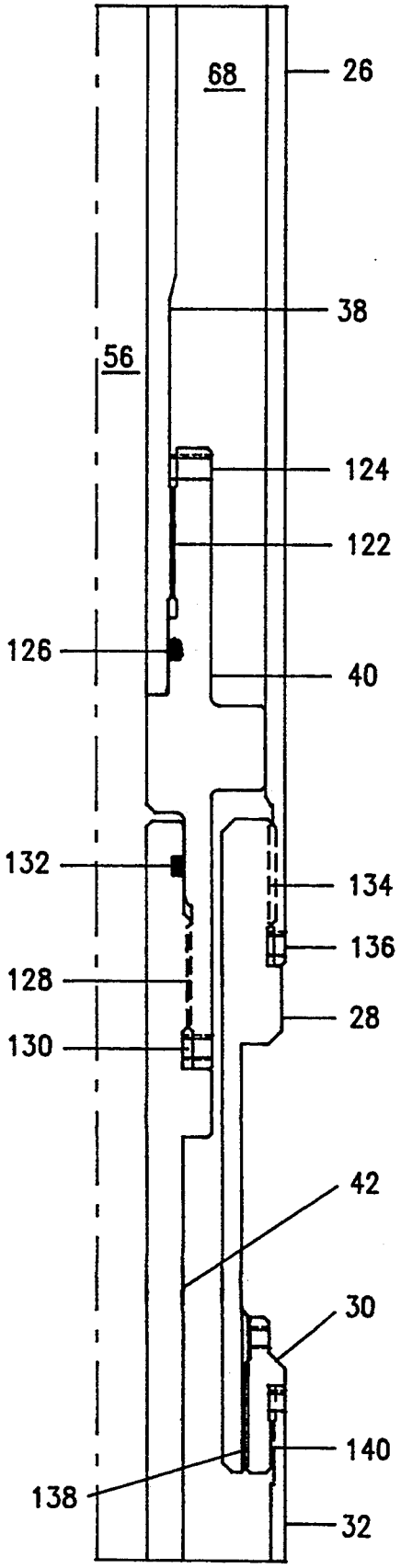
Figure 2D:
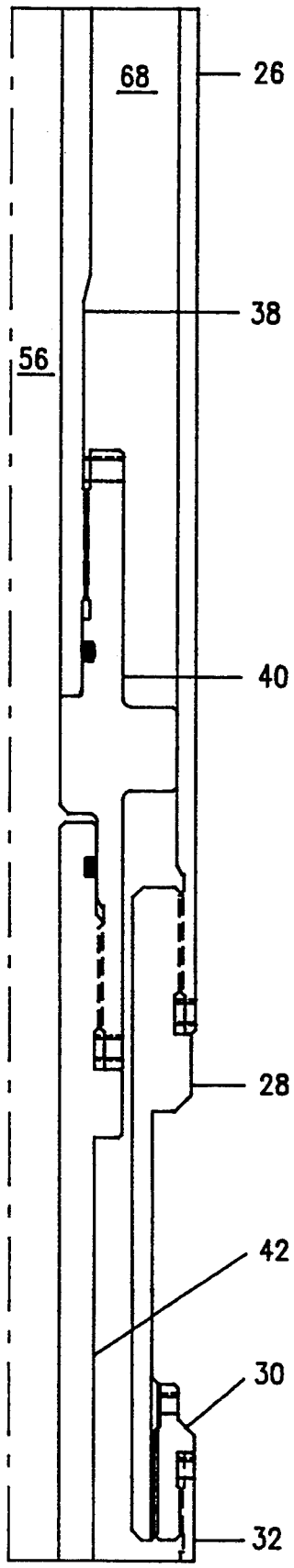
Figure 1E:
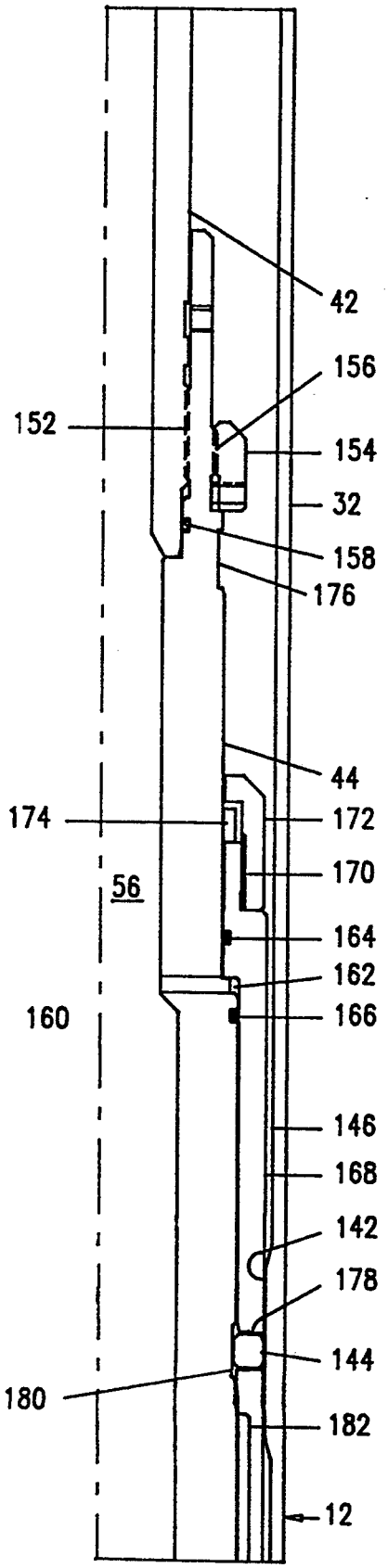
Figure 2E:
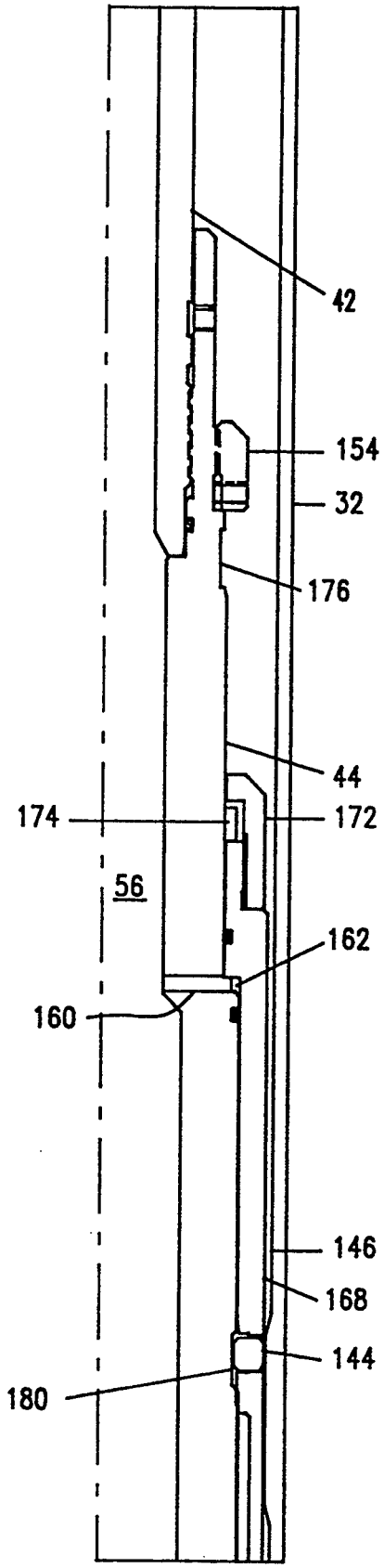
Figure 1F:
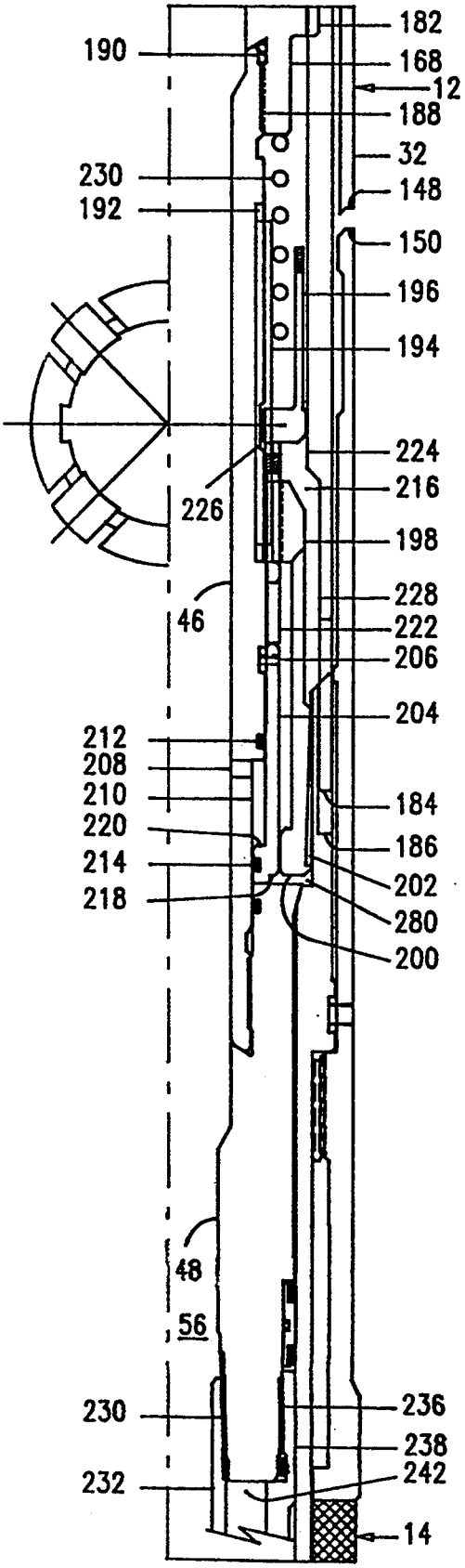
Figure 2F:
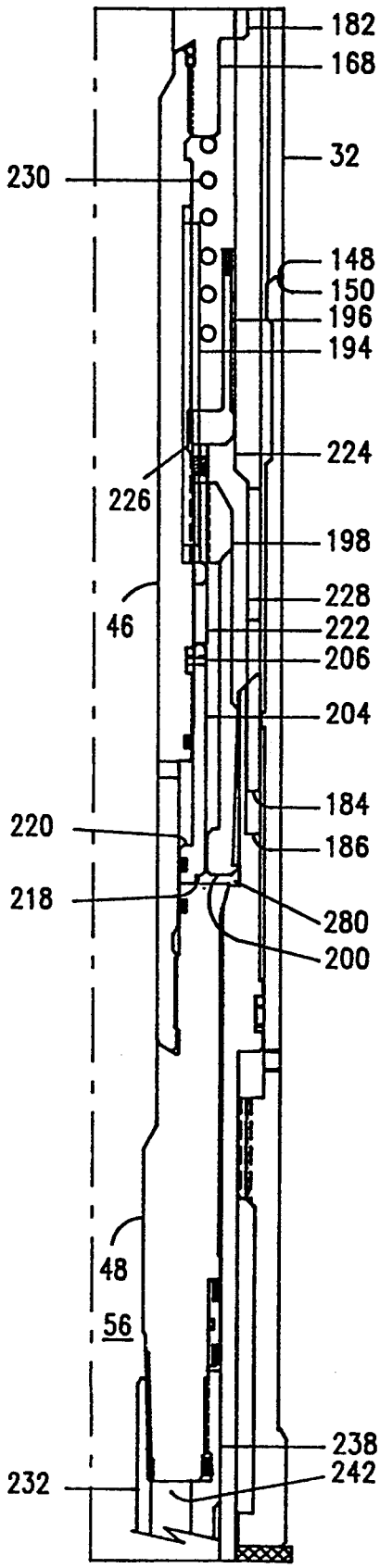
Figure 1G:
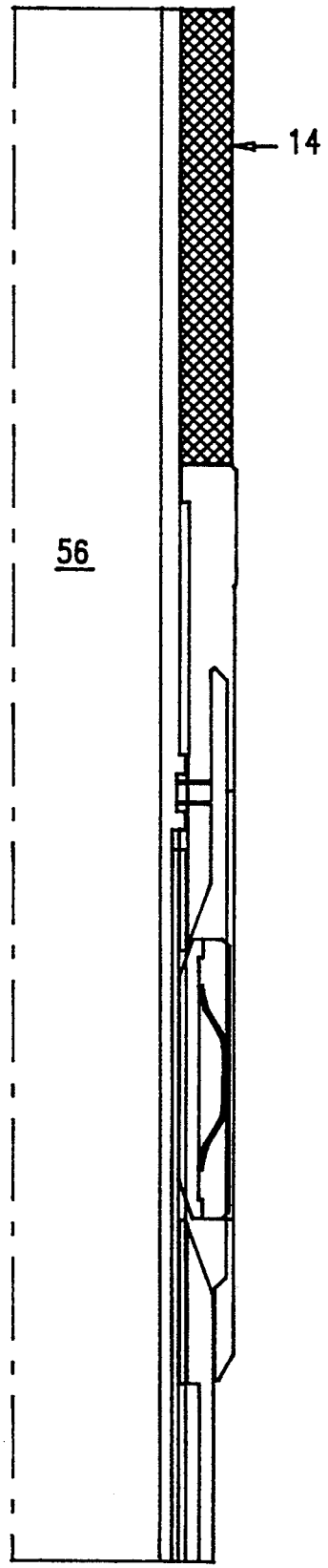
Figure 2G:
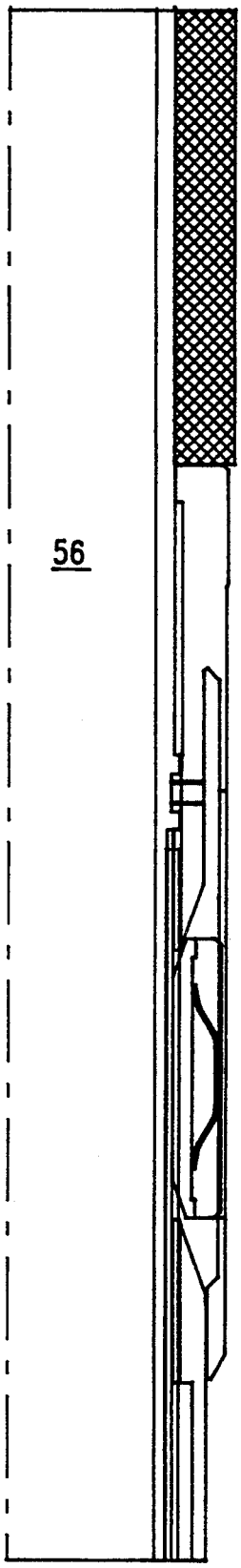
Figure 1H:
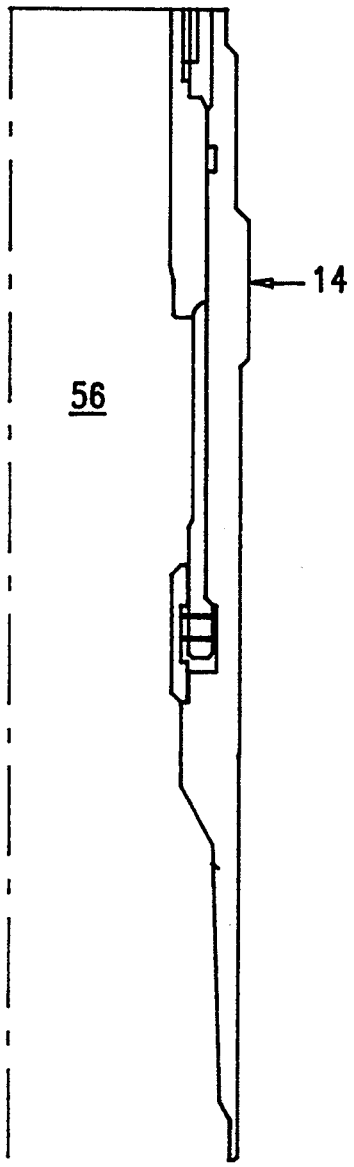
Figure 2H:
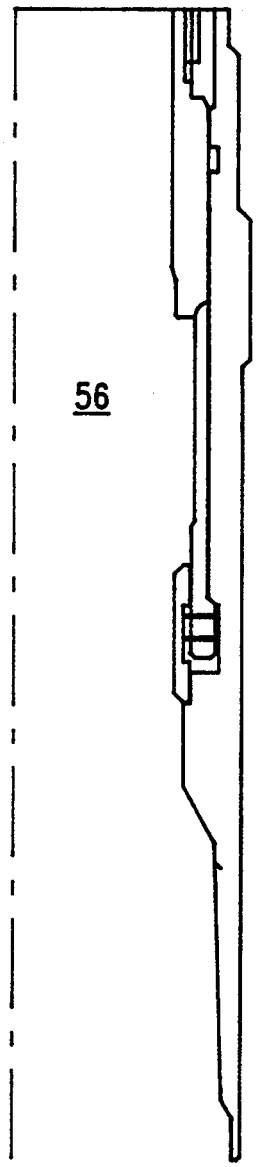
Figure 3A:
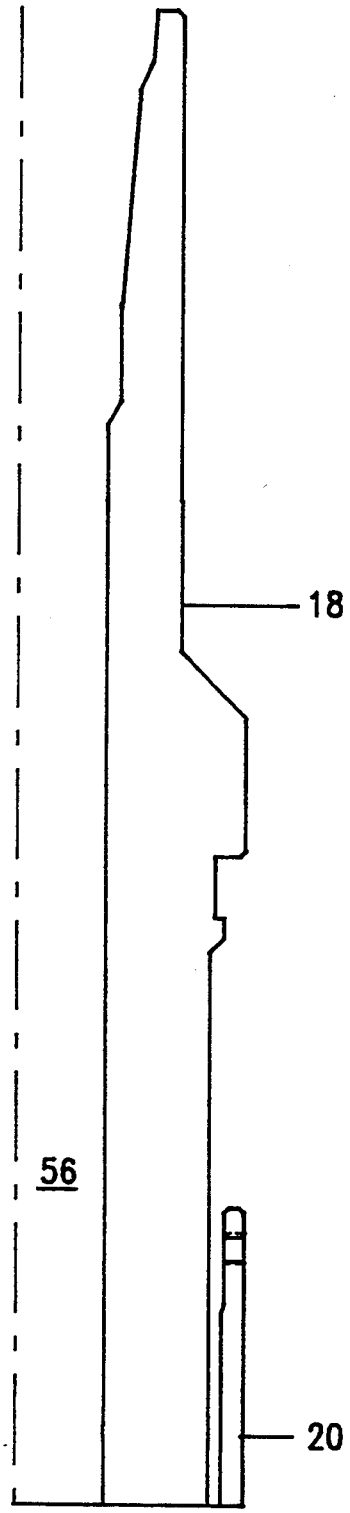
FIGS. 3A–3H is the view of FIG. 2 with the packer set, the seat sheared, and the rotational sleeve locked out.
Figure 4A:
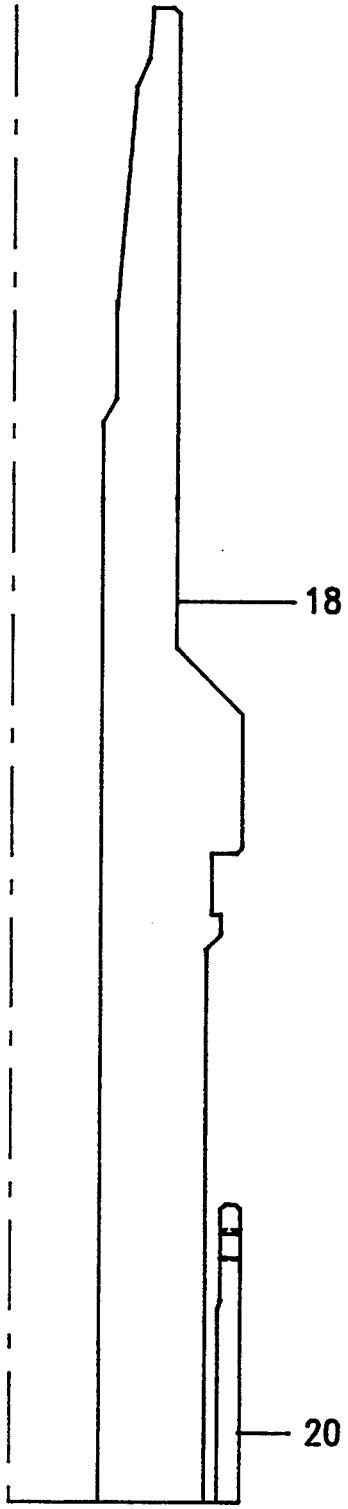
FIGS. 4A–4H is the view of FIG. 3, with the releasing sleeve shifted using annulus pressure.
Figure 3B:
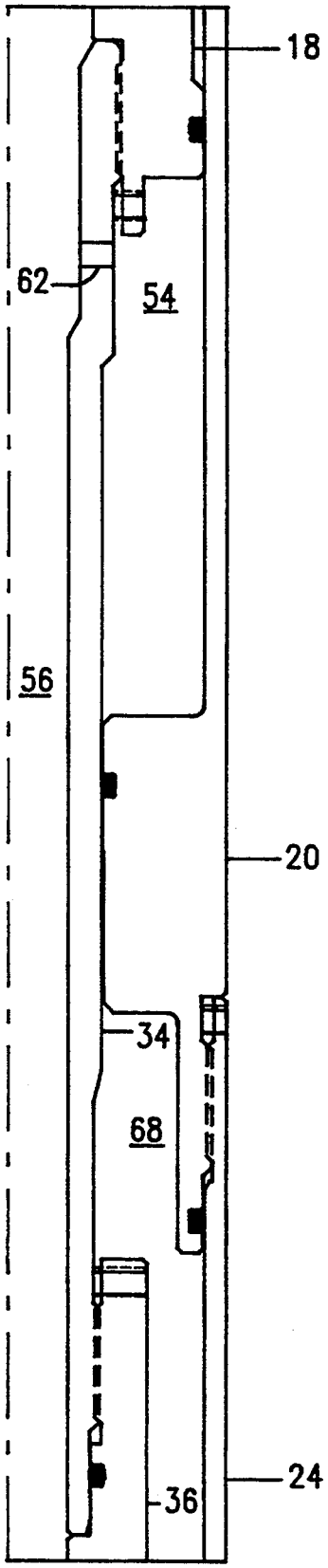
Figure 4B:
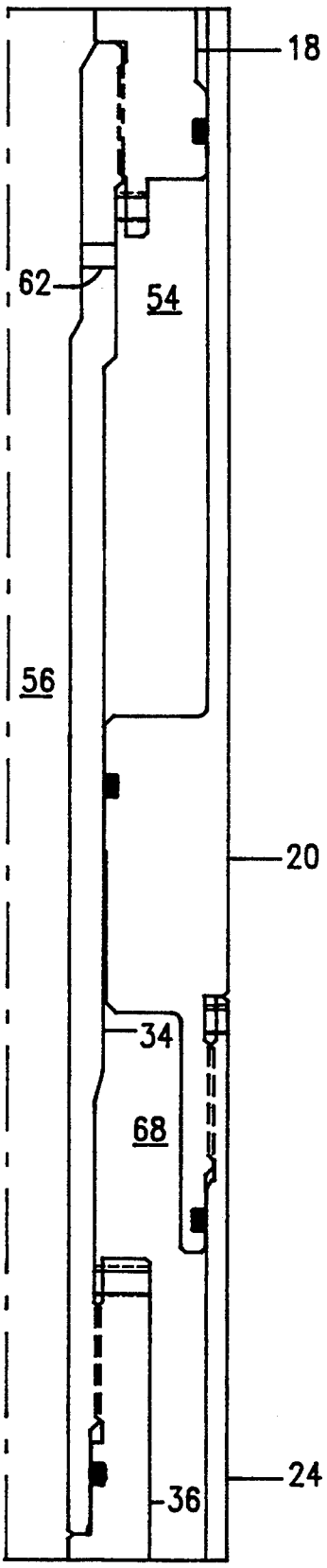
Figure 3C:
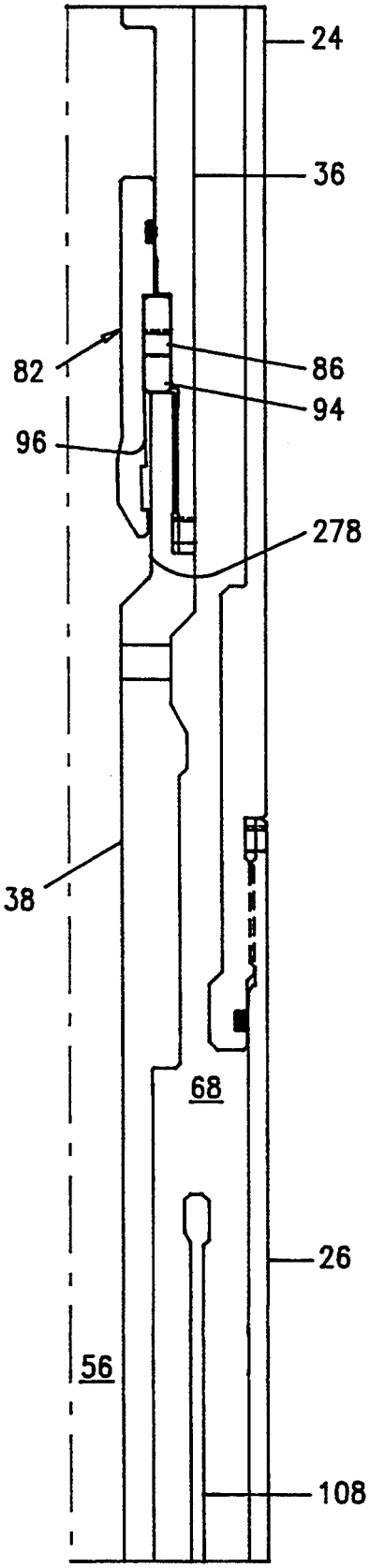
Figure 4C:
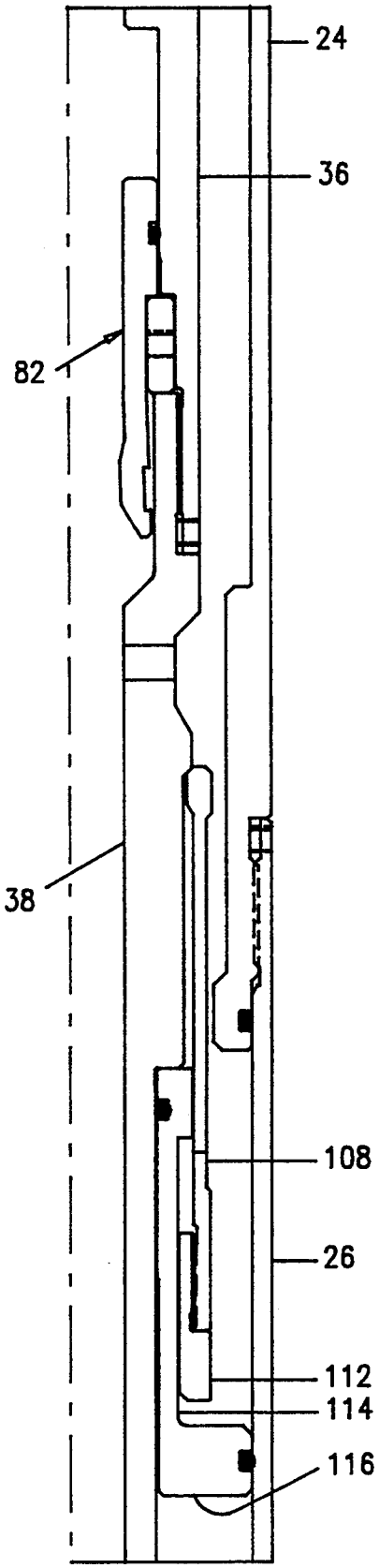
Figure 3D:
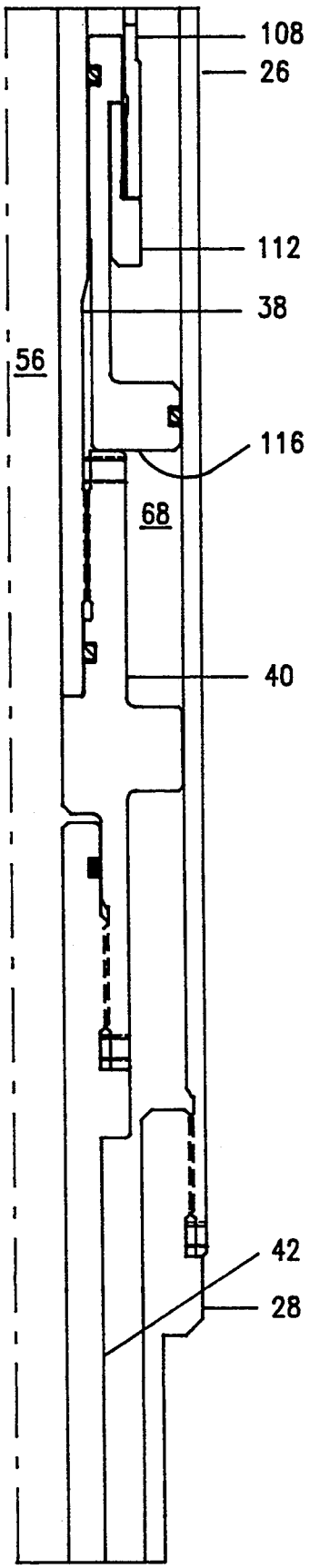
Figure 4D:
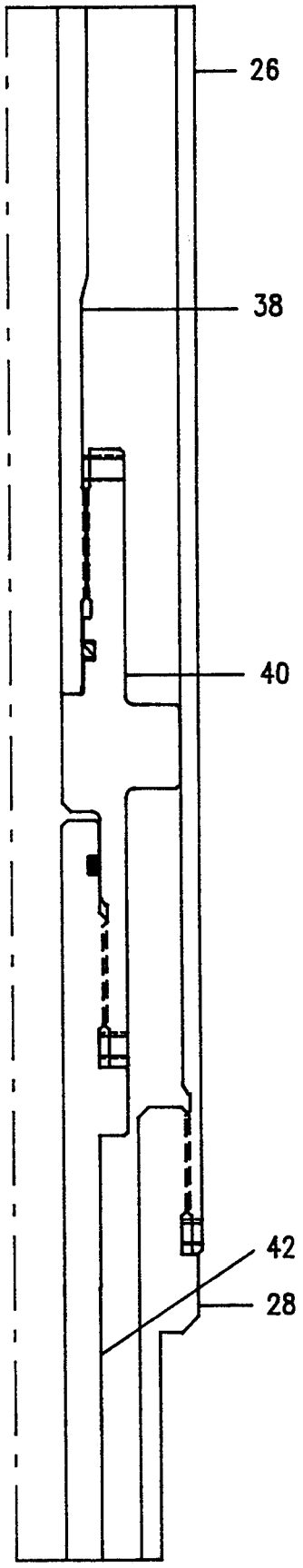
Figure 3E:
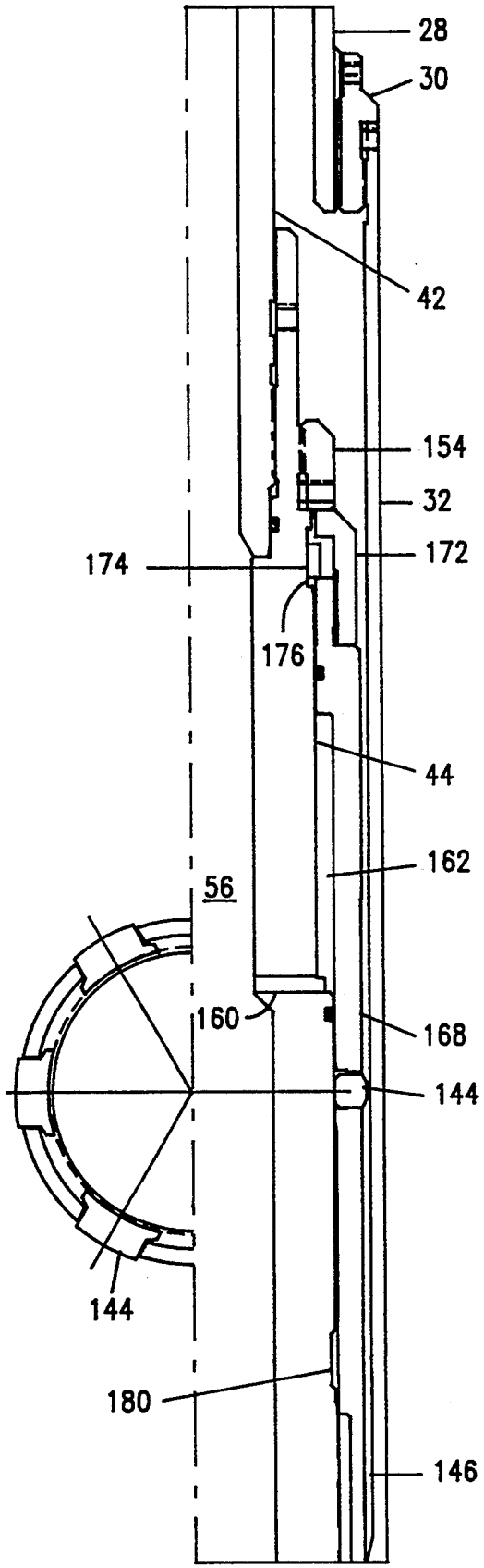
Figure 4E:
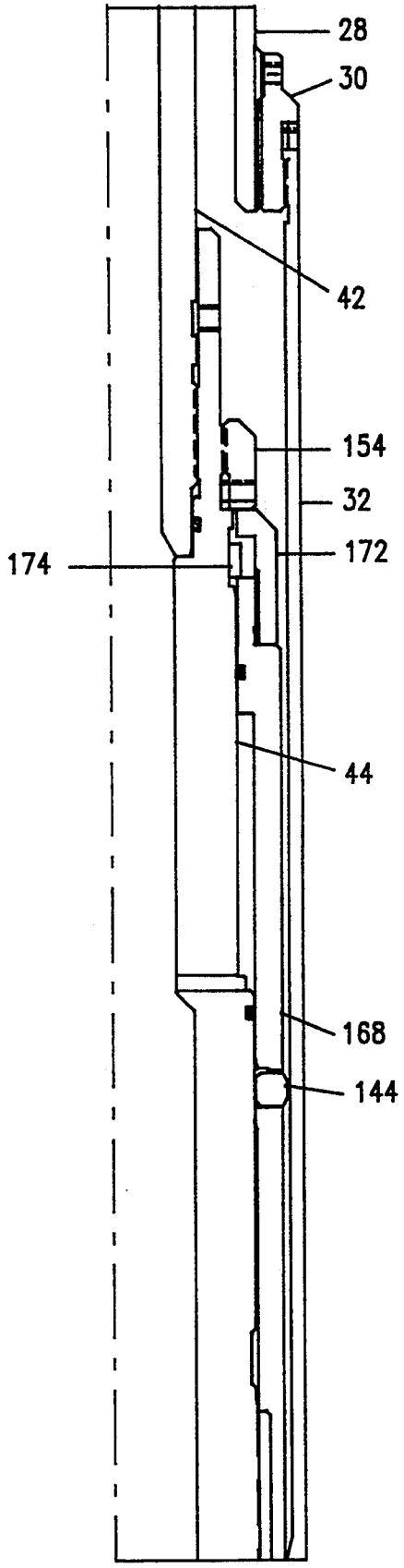
Figure 3F:
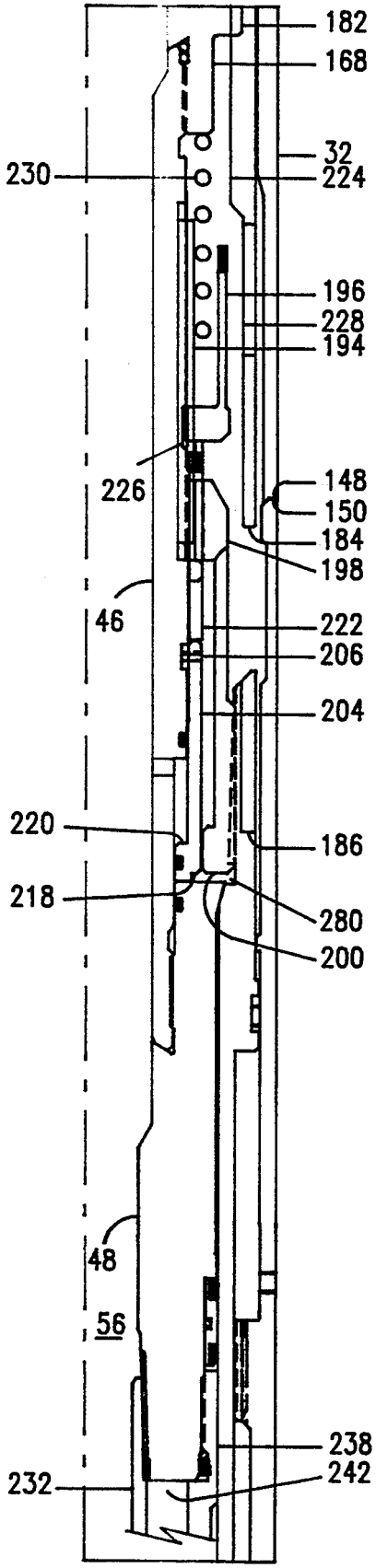
Figure 4F:
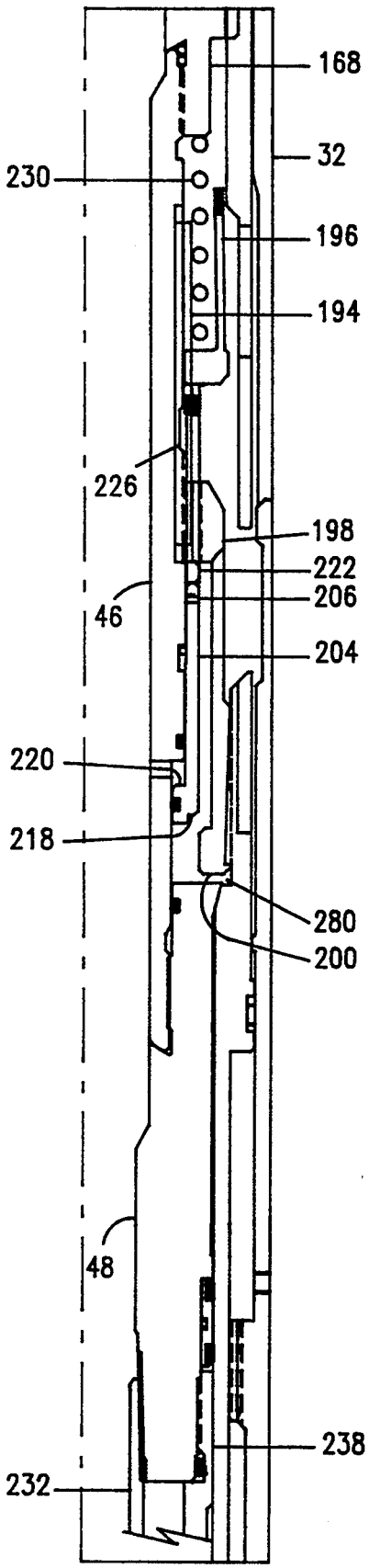
Figure 3G:
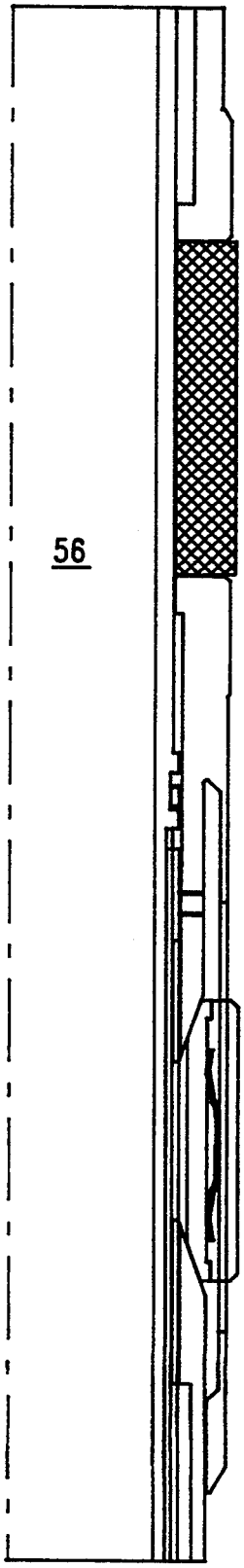
Figure 4G:
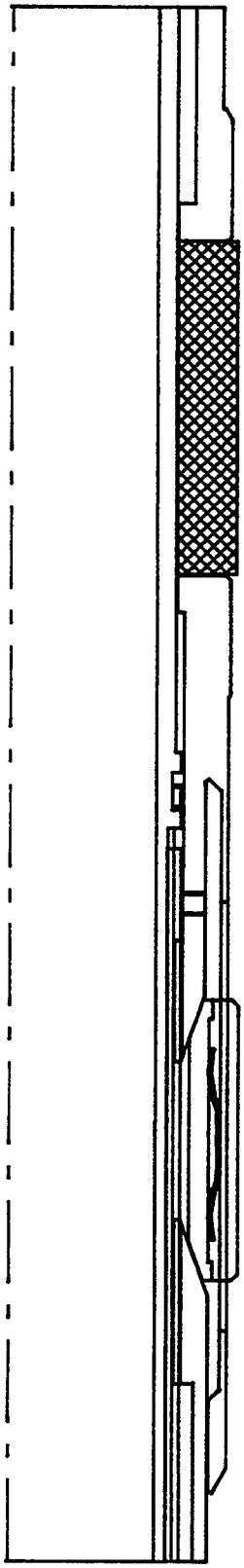
Figure 3H:
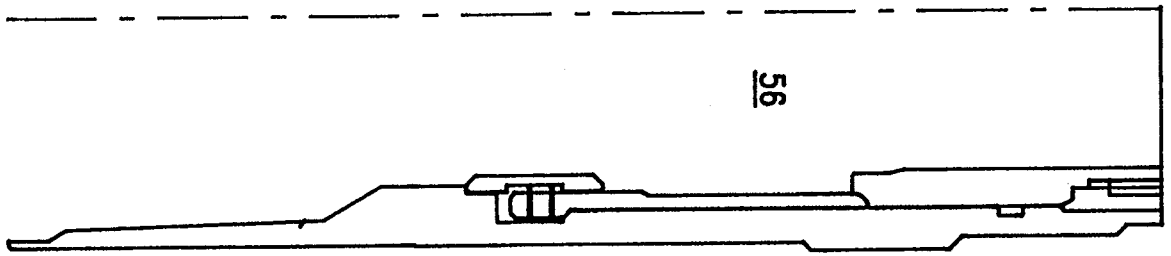
Figure 4H:
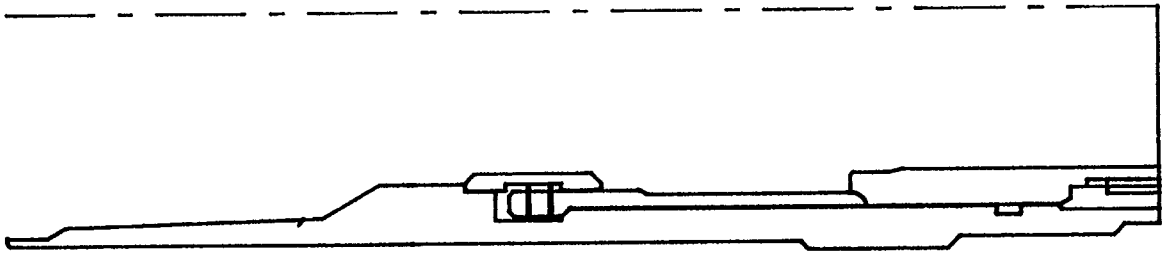
Figure 5A:
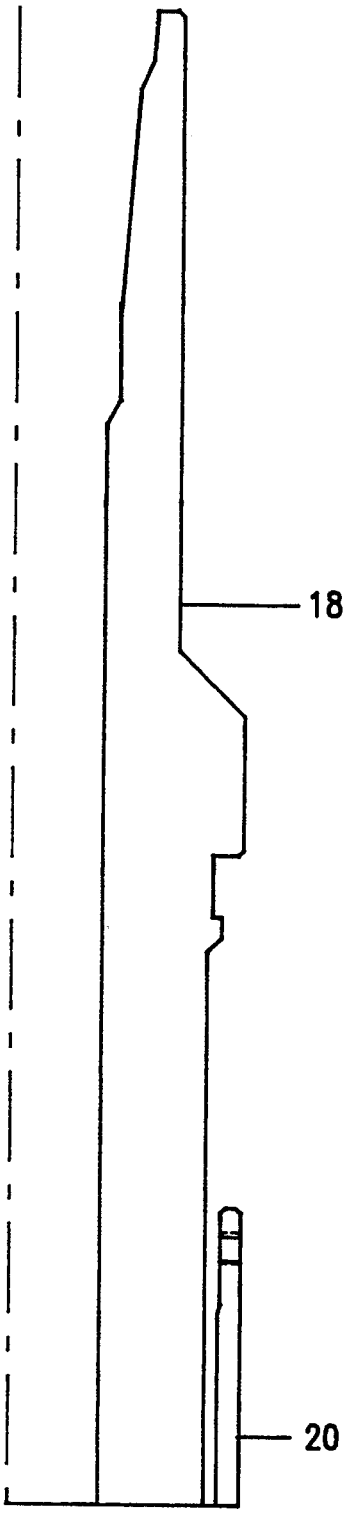
FIGS. 5A–5H is the view of FIG. 4, showing the apparatus in the set back down position used in doing a "squeeze" job.
Figure 5B:
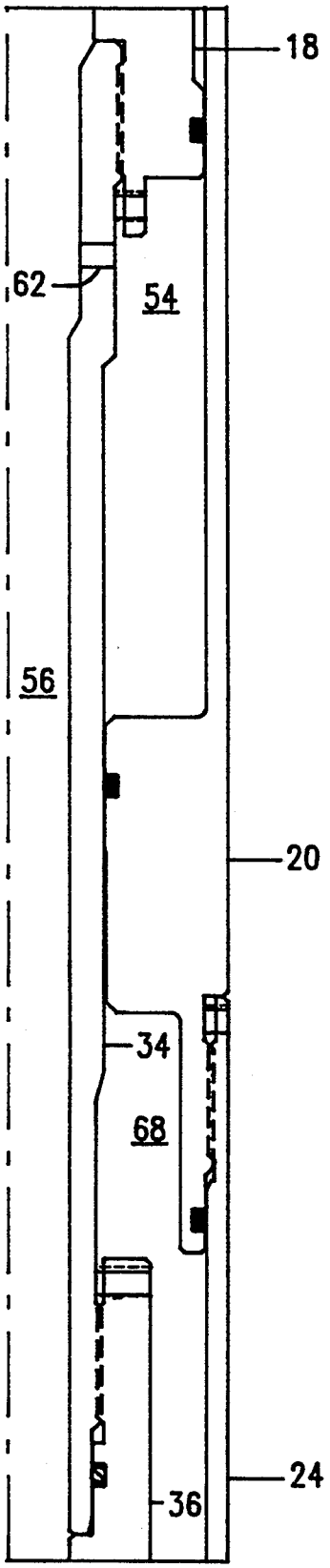
Figure 5C:
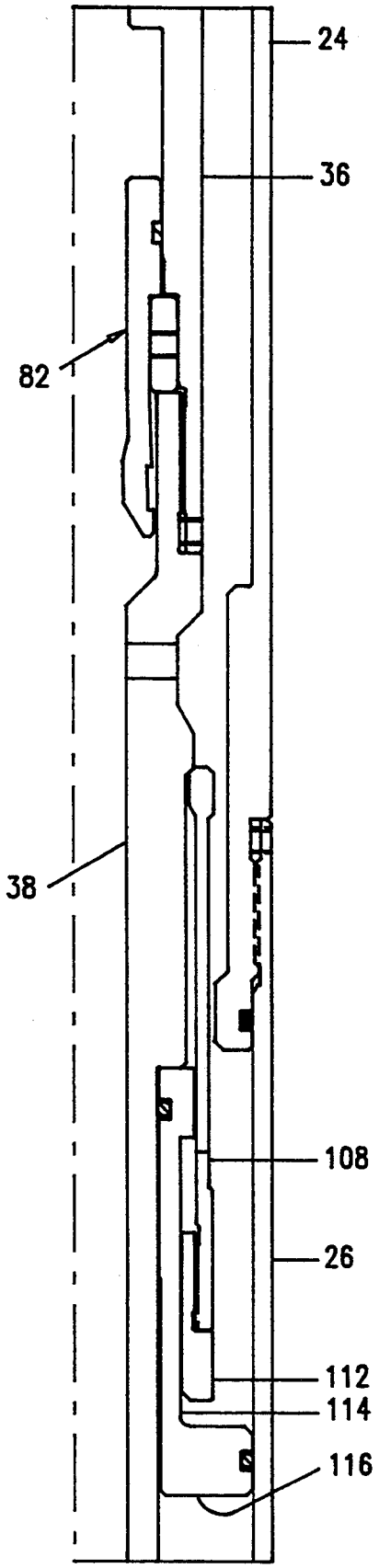
Figure 5D:
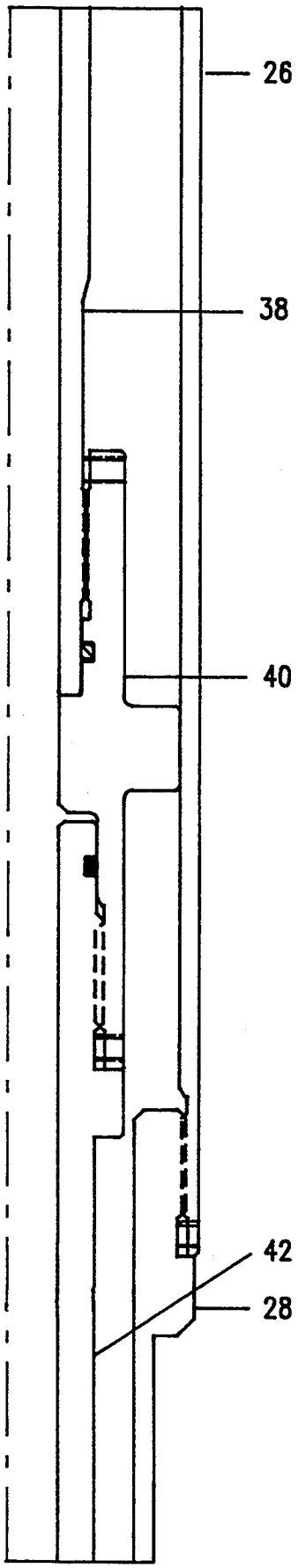
Figure 5E:
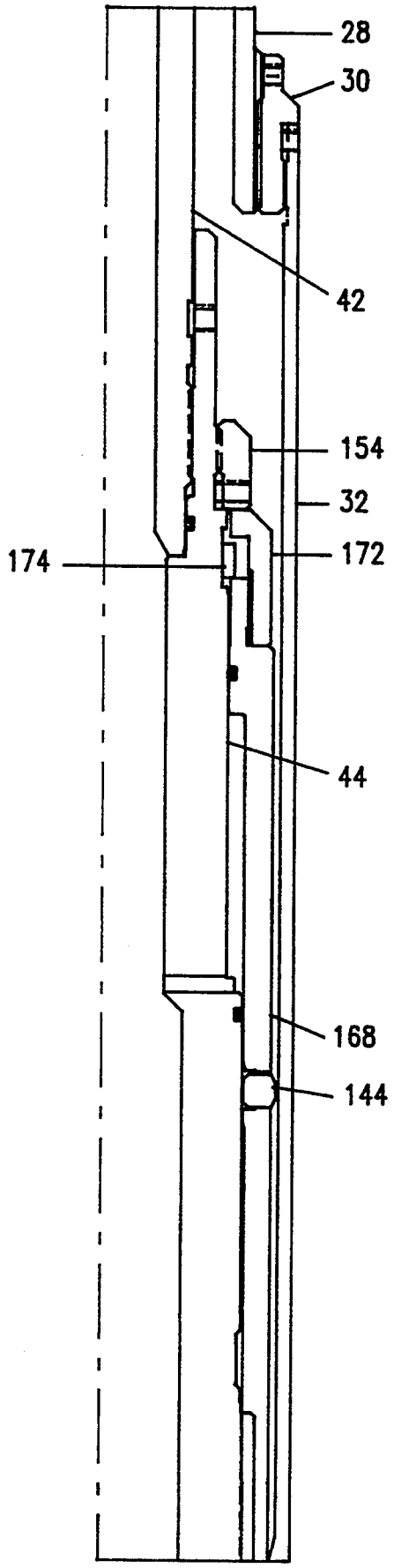
Figure 5F:
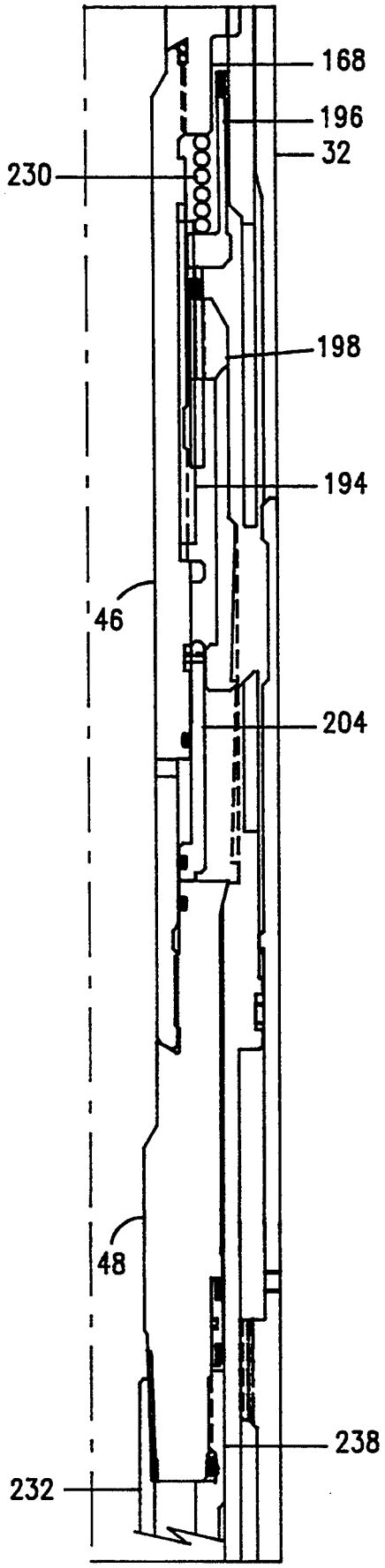
Figure 5G:
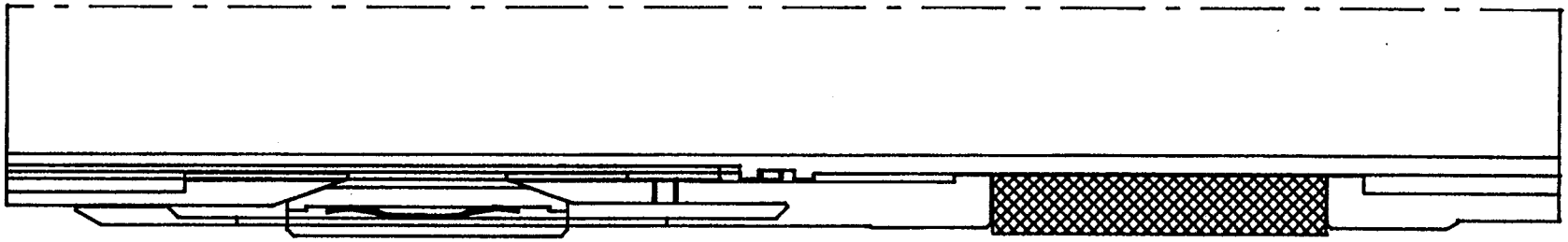
Figure 5H:
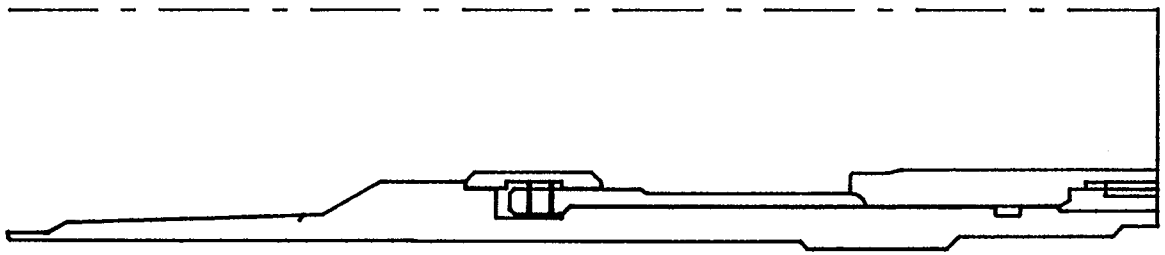
Figure 6A:
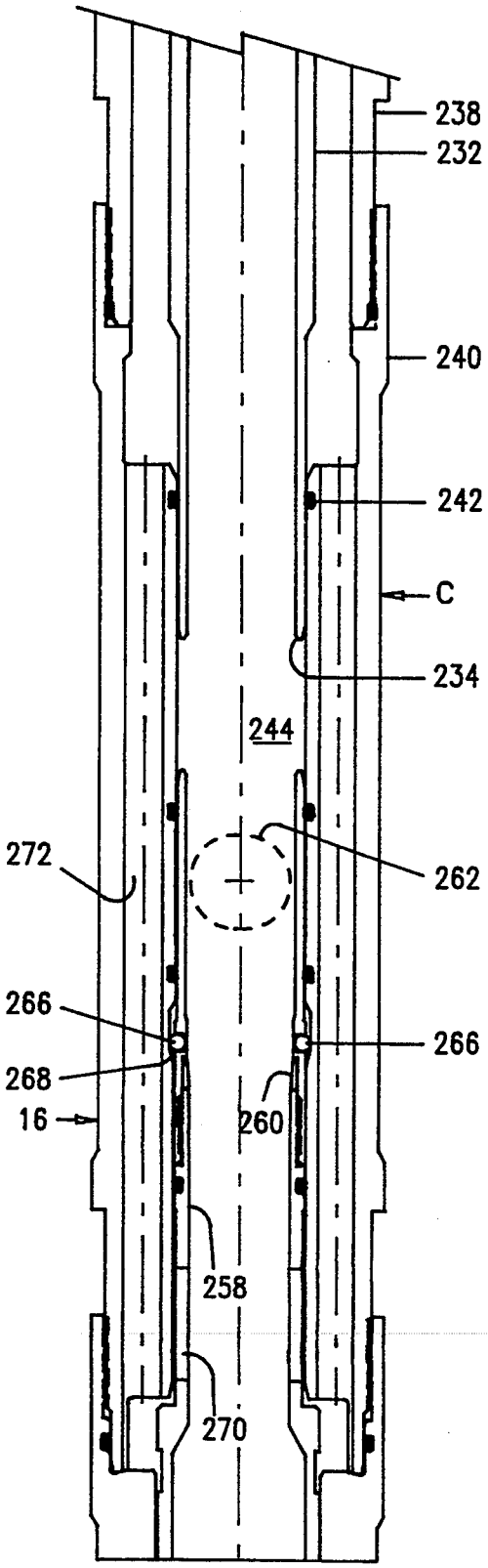
FIGS. 6A and 6B is a sectional elevational view of the gravel pack crossover assembly in its initial position.
Figure 7A:
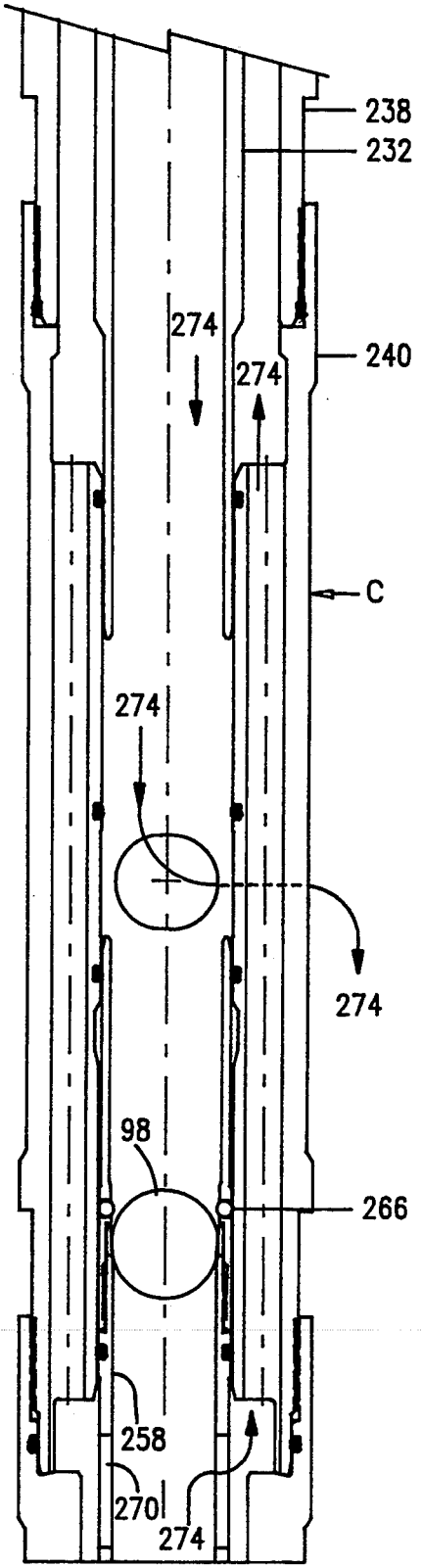
FIGS. 7A and 7B shows the crossover assembly of FIG. 6 in the crossover mode.
Figure 6B:
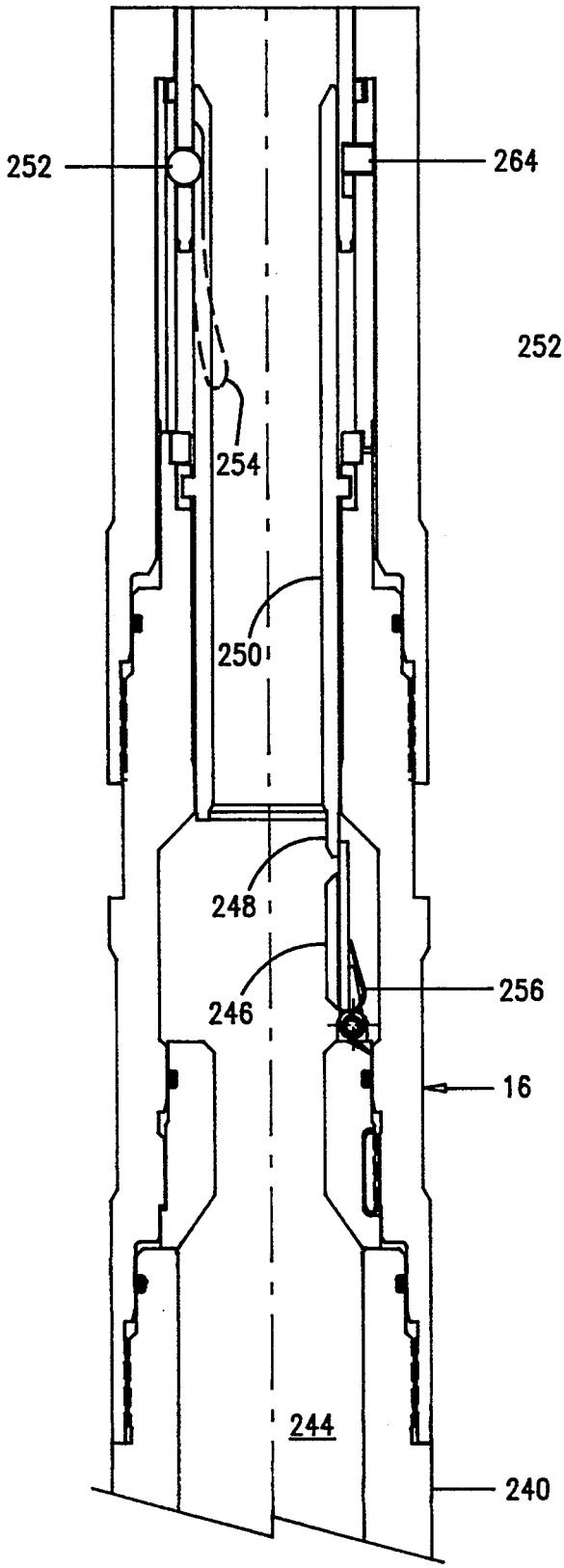
Figure 7B:
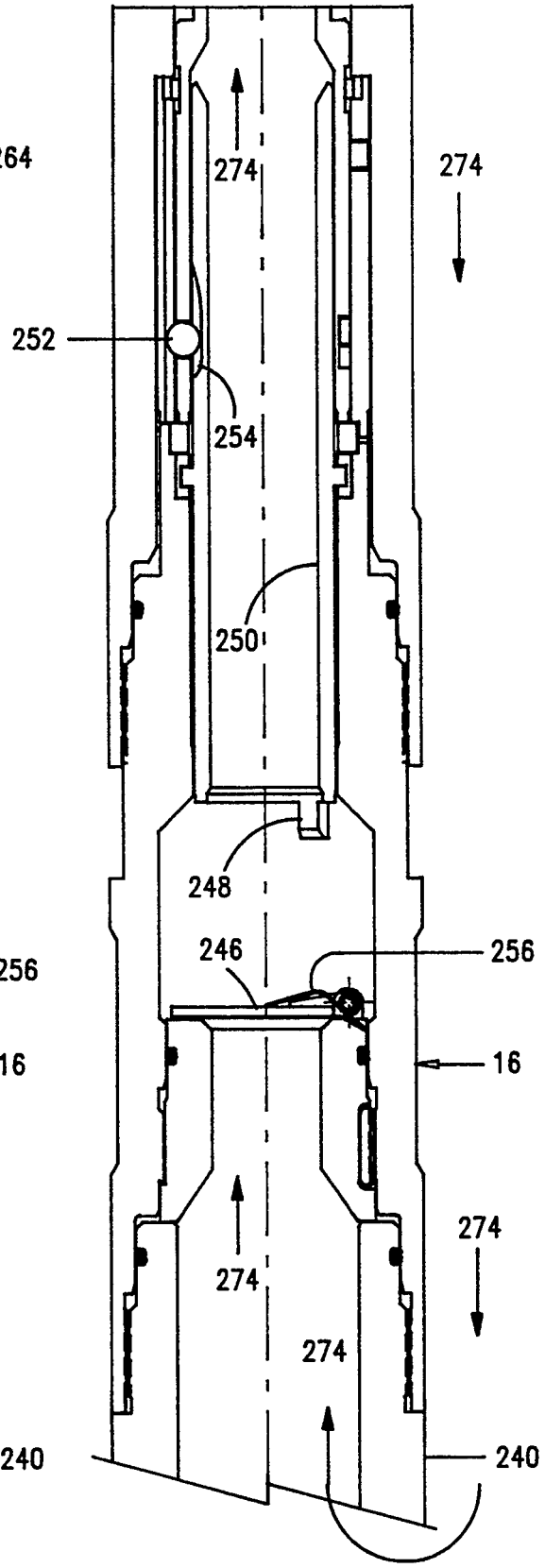

The apparatus A has an upper section 10 and a lower section 12. A packer assembly 14 is disposed adjacent lower section 12. The packer assembly 14 is of a substantially known design and does not form a part of the apparatus A of the present invention. Mounted below the packer assembly 14 is a crossover tool 16, as shown in FIGS. 6 and 7.

The upper section 10 comprises a top sub 18, as shown in FIG. 1. A pressure-balanced piston 20 is initially connected to the top sub 18 by virtue of shear pin 22. The work string (not shown) is mounted to the top sub 18 in the customary manner. Connected to the pressure-balanced piston 20 in series are upper housing 24, housing 26, piston extension 28, adjustment ring 30, and adapter sleeve 32. Connected to top sub 18 are upper mandrel 34, sleeve 36, lower mandrel 38, bottom connector sub 40, bottom sub 42, locking sub 44, mandrel 46, and locator sub 48.

Referring now to FIG. 1, the manner of connection of the components to top sub 18 will be reviewed. Pressure-balanced piston 20 circumscribes in part top sub 18 with seals 50 and 52 in between. Seals 50 and 52 isolate variable volume cavity 54 from the central flowpath 56. Upper mandrel 34 is also connected to top sub 18 at thread 58. The threaded connection 58 is secured by set screw 60. A port 62 extends laterally from central flowpath 56 into variable volume cavity 54. A seal 64 is disposed adjacent the threaded connection 66 to isolate variable volume cavity 68 from the outside of upper housing 26. Threaded connection 66 connects the pressure-balanced piston 20 to upper housing 26. Sleeve 36 is connected to the lower end of upper mandrel 34 at threaded connection 70, secured by set screw 72 and sealed by seal 74. Seal 74 also works to isolate variable volume cavity 68 from central flowpath 56. Sleeve 36 is connected to lower mandrel 38 at thread 90, which is secured by set screw 92. At the lower end of upper housing 24, housing 26 is connected at thread 76, with the set screw 78 retaining the threads engaged. Seal 80 also helps to seal off variable volume cavity 68 from the outside of housing 26. Abutting sleeve 36 is seat assembly 82, which includes a seating surface 84 and a shear pin 86 to selectively hold the position of seat assembly 82 to lower mandrel 38. A seal 88 is disposed between sleeve 36 and seating assembly 82. For ease of replacement of seat assembly 82, the shear pin 86 extends through ring 94. As seen in FIG. 3, when shear pin 86 breaks, ring 94 remains stationary, held in position by lower mandrel 38 with seat assembly 82 shifting downwardly, effectively leaving surface 96 unsupported, allowing for radial outward flaring of seating surface 84. As will be later explained, this allows the ball 98 (see FIG. 2) to pass seating surface 84.

A lateral port 100 allows fluid communication from central flowpath 56 into variable volume cavity 68 at a point adjacent collet heads 102. As seen in FIG. 1, the collet heads 102 are trapped between tapered surface 104 on lower mandrel 38 and surface 106 on upper housing 24. The collet heads 102 are connected to collet ring 108, which is connected by thread 110 to split nut 112. Split nut 112 is slidably mounted to surface 114 of compensating piston 116. Seals 118 and 120 are mounted to the compensating piston 116. Seal 120 seals between compensating piston 116 and housing 26, while seal 118 seals between compensating piston 116 and lower mandrel 38. Compensating piston 116 is movable within variable volume cavity 68 for reasons which will be described below. Bottom connector sub 40 acts as a travel stop for compensating piston 116, as shown in FIG. 3. Thread 122 secures bottom connecting sub 40 to lower mandrel 38. Set screw 124 secures the threaded connection 122, and seal 126 seals between the two members 38 and 40. Similarly, thread 128 connects bottom connecting sub 40 to bottom sub 42, with set screw 130 securing the threaded connection 128 and seal 132 sealing off the same connection.

Continuing down with housing 26, thread 134 connects housing 26 to piston extension 28, with set screw 136 securing the connection. Similarly, thread 138 connects piston extension 28 to adjustment ring 30, and thread 140 connects adjustment ring 30 to adapter sleeve 32. In the run-in position shown in FIG. 1, raised surface 142 traps locking keys 144. As shown in FIGS. 2 and 3, shifting of adapter sleeve 32 with respect to locking keys 144 moves surface 142 away from locking keys 144, thus unlocking them. See FIG. 3. The locking keys 144 are unlocked when surface 146 appears opposite locking keys 144, as shown in FIG. 3. Adapter sleeve 32 has a lower end 148, which is in alignment with packer setting sleeve 150. The packer assembly 14, as previously stated, is contemplated to be a type known in the art, which is settable by a setting sleeve, such as 150. As seen from FIGS. 2 and 3, downhole motion of adapter sleeve 32 impacts setting sleeve 150 to set the packer assembly 14.

Switching back to bottom sub 42, thread 152 secures bottom sub 42 to locking sub 44. Stop ring 154 is connected by thread 156 to locking sub 44. Seal 158 seals between locking sub 44 and bottom sub 42.

A lateral port 160 extends from the central flowpath 56 into variable volume cavity 162. Seals 164 and 166 seal off variable volume cavity 162. Rotational lock 168 has several features. Adjacent its top end is a threaded connection 170 to secure retaining nut 172. Retaining nut 172 bridges over and loosely retains retaining ring 174 loosely against locking sub 44. Ultimately, as illustrated in FIGS. 2–3, applied pressure in port 160 shifts rotational lock 168 until retaining ring 174 falls into groove 176 on locking sub 44. Rotational lock 168 has a series of windows 178 through which locking keys 144 extend. One or more locking keys 144 can be used without departing from the spirit of the invention. Locking sub 44 has a recessed surface 180. In the run-in position, shown in FIG. 1, locking keys 144 are trapped between surface 142 on adapter sleeve 32 and recessed surface 180 on locking sub 44. Locking sub 44 has a series of splines 182 which extend into slots (not shown) in rotation lock 168. The lower end 184 comprises a series of fingers which extend into mating grooves 186 on the packer assembly 14. Accordingly, the ends 184, while extending into the longitudinal grooves 186, cannot rotate with respect to packer assembly 14.

Thread 188 is at the lower end of locking sub 44 and connects locking sub 44 to mandrel 46. The connection is sealed by seals 190. Mandrel 46 has at least one keyway 192 in which is located a key 194. Key 194 extends the substantial length of keyway 192 and through keyways (not shown) machined into locking collet 196, as well as latch 198. Latch 198 has a plurality of collet fingers 200. On the outer face of collet fingers 200 is preferably a left-hand thread 202 which adapts to a similar thread on the packer assembly 14 in the area adjacent grooves 186. In the run-in position, the collet fingers 200 are supported by unbalanced piston 204, which is optionally secured in its run-in position by shear screw 206. Port 208 communicates with variable volume cavity 210, which is in turn sealed by seals 212 and 214. Cavity 216 is exposed to annulus pressure, which in turn tends to put an upward force on unbalanced piston 204 at its lower end 218. An opposing force is exerted on surface 220 as a result of fluid pressures applied from central flowpath 56 through port 208 into variable volume cavity 210.

In the run-in position, the unbalanced piston 204 is not only secured to its position optionally by shear screw 206, but it also abuts the lower end 222 of locking collet 196. Locking collet 196 is itself trapped between surface 224 and recess 226, located respectively on rotational lock 168 and mandrel 46. As will be explained later, locking collet 196 can become liberated from its longitudinally interengaged position with respect to mandrel 46 when shifting of rotational lock 168 presents surface 228 opposite locking collet 196, as shown in FIG. 3. It should be noted that presenting surface 228 opposite locking collet 196 does not necessarily make unbalanced piston 204 move, which would in turn make locking collet 196 move out of recess 226. It takes the sufficient application of an unbalanced force in the annulus over that in central flowpath 56 to actuate movement of unbalanced piston 204, as will be explained below and is illustrated by comparing FIGS. 3 and 4.

Accordingly, key 194 prevents relative rotation as between mandrel 46 on one hand and locking collet 196 and latch 198 on the other hand. As previously stated, rotational lock 168 is also prevented from relative rotation with respect to locking sub 44 due to splines 182 on locking sub 44 extending into longer slots (not shown) in rotational lock 168.

Spring 230 is installed optionally and facilitates assembly of the components of the apparatus A.

Initially supporting the unbalanced piston 204 is locator sub 48. Locator sub 48 has an internal thread 230 to which is connected a bypass tube 232, shown schematically. Bypass tube 232 continues and ends at lower end 234, shown in FIG. 6. An external thread 236 connects a schematically shown outer tube 238, which extends through the packer assembly 14 and into housing 240, shown in FIG. 6. As a result, an annular space 242 is created between bypass tube 232 and outer tube 238 for purposes of use of the crossover assembly C, as will be explained below.

Referring now to FIG. 6, some of the details of the crossover assembly C will be described. Bypass tube 232 sealingly slides into housing 240, with the connection sealed by seal 242. Housing 240 has an inner bore 244, which extends through the entire housing 240, which is shown in FIG. 6 to be made of several component pieces. Valve 246 is held in the open position during run-in by a tang 248. As seen by comparing FIG. 6 to 7, eventually sleeve 250 is urged to rotate as ball 252 is urged downwardly through spiral slot 254 by the advancement of sleeve 258. The rotated position of sleeve 250 is shown in FIG. 7, with valve 246 urged into the closed position due to spring 256. Sleeve 258 is also mounted within housing 240 and contains a seat 260, which ultimately catches ball 98, as shown in FIG. 7. When ball 98 seats on seat 260, it shifts sleeve 258 downwardly, breaking shear screws 264 and forcing sleeve 258 downwardly with respect to housing 240. This downward shift ramps retaining members 266 along tapered surface 268, thus retaining ball 98 in a fixed position seated against seat 260. It should be noted that different forms of retaining mechanisms can be employed other than ball 98 without departing from the spirit of the invention. Similarly, different types of shapes can be used other than spheres without departing from the spirit of the invention. What is significant is to obtain a pressure seal to allow pressure buildup and to be able to retain that seal even though differential pressures go to zero or, in fact, are reversed, meaning the unseating pressure exceeds the seating pressure at ball 98 or whatever similar mechanism is used to retain the seal. During the run-in position, the port 262 is covered by sleeve 258 so that flow can go from the surface through central passage 56, as shown in FIGS. 1–4, down passage 244 and out to the bottom of the liner (not shown). This is an advantage over previous designs since the assembly of the present invention allows for circulation or reverse circulation down to the bottom of the liner without fear of actuation of the setting mechanism for the packer assembly 14 or without fear of disconnection at left-hand thread 202. Not only pressure, but rotation can be applied for the initial circulation down to the bottom of the liner (not shown) to clear up debris from the wellbore. Of course, when needing to do a gravel pack job, the crossover assembly C, as illustrated in FIGS. 6 and 7, is used. Otherwise, the crossover assembly C can be eliminated in favor of simply running a liner (not shown) in conjunction with the packer assembly 14 with the addition of a second place to seal off flowpath 56 at any point below port 160.

Having seated ball 98 on seat 260 and shifted sleeve 258 downwardly, which causes sleeve 250 to rotate and release valve 246, the crossover assembly C is now in the crossover position shown in FIG. 7. In the crossover position, the gravel can be fed into bore 244, which is now interrupted by ball 98. However, port or ports 262 are now open for the gravel to exit housing 240 and to deposit on the outside of the liner (not shown). The fluid passes around under the bottom of the liner, leaving the gravel behind and returning into the lower end of housing 240 back into bore 244 below ball 98. The pressure, which is supplied from the surface to deliver the gravel to the outside of the liner (not shown), provides the motive force for continuing flow uphole in bore 244 so as to eventually overcome the force of spring 256 and urge valve 246 back into the open position. The returning fluids cross over through port or ports 270 up through longitudinal bores 272 and in through the packer assembly 14 and back out into the annulus (not shown) uphole from packer assembly 14. Arrows 274 illustrate this flowpath in FIG. 7.

All of the significant components of the apparatus now having been described, its operation will be reviewed, starting with the run-in position of FIG. 1. As shown in the run-in position in FIG. 1, the apparatus A is fully locked against any release of left-hand thread 202, as well as any setting of the packer assembly 14 by application of pressure, either in the annulus outside the apparatus A or pressure applied in central passage 56. It should be noted that it is within the scope of this invention to provide a locking mechanism for the packer assembly 14 wherein the lock assembly provided prevents accidental release of the packer assembly 14 in the face of applied rotation such as could occur if the string is stuck on insertion or removal. Additionally, it is also one of the aspects of the present invention to provide not only a rotational lock against accidental disengagement, but also a lock against inadvertent setting of the packer assembly 14 due either to applied pressure or rotational forces.

As noted previously, the piston 20 is pressure balanced, meaning that without obstruction of central passage 56 between ports 100 and 62, movement of piston 20 cannot occur since equal and opposite forces on piston 20 will always be present in variable volume cavities 54 and 68, which cancel each other out. As shown by comparing FIG. 1 and FIG. 2, the ball 98 is dropped until it seats against seat 84. While a ball has been shown to effect an unbalanced force on piston 20, other mechanisms can be used which are essentially in pressure balance until a deliberate act is taken to create a situation conducive to a pressure imbalance. Other mechanical or hydraulic or hybrid mechanisms that do not actuate until a deliberate act is done other than a twist, a longitudinal force or applied pressure can also be within the scope of the invention. When the ball 98 in the preferred embodiment is seated against seat 84, pressure can be built up from the surface, which communicates directly into variable volume cavity 54. Since the built up pressure in central passage 56 exceeds the pressure in the annulus (which would be then the same as the pressure downstream of seated ball 98), the pressure in variable volume cavity 54 is raised to a level greater than variable volume cavity 68. As a result, piston 20 shifts downwardly, as well as all of the other components hooked up to it rigidly, which include upper housing 24, housing 26, piston extension 28, adjustment ring 30, and adapter sleeve 32.

In order to move piston 20 downwardly, shear pin 22 is broken, as shown in FIG. 2. Further, as a result of shifting of piston 20, surface 106 on upper housing 24 moves away from collet heads 102, thus allowing collet heads 102 to move radially outwardly toward surface 276 of upper housing 24. Since movement of piston 20 enlarges variable volume cavity 54, but decreases the volume of variable volume cavity 68, the displaced volume of variable volume cavity 68 is compensated by allowing compensating piston 116 to move downwardly, as shown in FIG. 3. Compensating piston 116 can make this movement because of the shifting of piston 20 which has just liberated the collet heads 102, which in turn have held the compensating piston 116 in a fixed position, as shown in FIGS. 1 and 2. The fully released and final position of compensating piston 116 is shown in FIG. 3. The provision of compensating piston 116 is necessary because at times the central passage 56 is located in a position where the flowpath can be deliberately obstructed near the bottom of the liner assembly (not shown). In those situations, the displaced liquid volume due to motion of piston 20 cannot escape through port 100 because of the lower end obstruction in the flowpath 56 at the bottom of the hole. For example, a second packer or plug may be in the bottom of the hole and the procedure may call for setting down the liner on the plug in such a manner as to obstruct the flowpath 56. To avoid locking piston 20, the liberation of compensating piston 116 by release of collet heads 102 allows piston 20 to move downwardly, while at the same time the displaced volume is compensated by movement of piston 116.

Movement of piston 20 ultimately brings lower end 148 in contact with packer setting sleeve 150 which, upon displacement of setting sleeve 150, sets the packer assembly 14 in the customary manner. As these movements are occurring, raised surface 142 moves away from locking keys 144 and, instead, surface 146 presents itself opposite locking keys 144. Once this occurs, locking keys 144 are free to clear recess 180 which then releases the interengaging relationship between locking sub 44 and rotational lock 168. When this occurs, as shown in FIG. 3, there as yet is no relative longitudinal movement between rotational lock 168 and locking sub 44.

Sequentially, the next step that occurs after shifting of piston 20 is the increasing of surface pressure in flowpath 56 until the applied force transferred from ball 98 to seat 84 exceeds the shear resistance of shear pin 86. At that time, as shown in FIG. 3, shear pin 86 breaks. The uphole pressure on ball 98 forces seat assembly 82 downwardly such that surface 96 moves off of ring 94 and becomes unsupported as it faces surface 278 of lower mandrel 38. At this time, due to the lack of support for the lower end of seat assembly 82, it literally flares outwardly allowing ball 98 to pass beyond seat 84. The deformation of seat assembly 82 may be elastic or plastic. Alternative mechanisms can be used to selectively retain ball 98 and subsequently release it upon application of further pressure. Different mechanisms can be used to isolate flowpath 56 between port 62 and 100 so as to permit the application of an unbalanced force to piston 20 without departing from the spirit of the invention. What is illustrated is the preferred embodiment of initiating the motion of balanced piston 20.

As shown in FIG. 3, when sufficient pressure has been applied to ball 98, it clears seating surface 84 and travels down path 56 to seat 260, shown in FIG. 6. By this time, the ball 98 has traveled through the packer assembly 14 and has entered the crossover assembly C. At this time, additional pressure from the surface may be required to actuate the movements in the crossover assembly C. Upon application of further pressure from the surface, sleeve 258 moves downwardly shearing pin 264. As sleeve 258 shifts downwardly, it forces ball 252 along slot 254. Since sleeve 258 is locked against rotation and sleeve 250 is free to rotate, but not to translate, the longitudinal movement of sleeve 258 translates to a rotational movement of sleeve 250. Consequently, tang 248 moves away from valve 246 allowing spring 256 to bring the valve 246 to its closed position shown in FIG. 7. The shifting of sleeve 258 has also now exposed port or ports 262 and has allowed a flowpath to be created from bore 244 out through ports 262 and through the housing 240 into the annular space outside of the liner assembly, not shown, which is normally suspended from the lower end of packer assembly 14. It should be repeated that the crossover assembly C is an optional feature useful in a gravel packing procedure and may be completely omitted if gravel packing is not required. In either event, a seat 260 is provided so as to sealingly capture ball 98 after it is liberated by seat assembly 82.

Another consequence of shifting sleeve 258 is that balls 266 are driven along tapered surface 268 and in effect lock the ball 98 to seat 260. Thereafter, even if differential pressures are applied to ball 98 in either direction, ball 98 will not come away from seat 260. Sometimes during the circulation or reverse circulation operations involved crossover sub C, the seating pressure on ball 98 can literally disappear, and it has been learned in the past that the sealing integrity at seal 260 is lost. In these situations, the ball either floats slightly above the seat 260 or due to a reverse in pressures, can literally be driven up bore 244 and bore 56 to a position making it hard to find and reposition against seat 260. Accordingly, one of the aspects of the invention is to provide a retaining mechanism, the preferred embodiment of which is illustrated in FIGS. 6 and 7 using balls 266. However, other mechanical or hydraulic devices, which physically retain the sealing member, in this case a ball 98 to a seat 260 are also within the purview of the invention.

Prior to the movements above, having seated ball 98 on seat 260, pressure is then raised from the surface into flowpath 56, which now, through passage 160, allows pressure to build up in volume cavity 162, as seen by comparing FIGS. 2 and 3. This buildup occurs because shear pin 264 keeps sleeve 258 in a position covering ports 262. As the volume of variable volume cavity 162 increases, rotational lock 168 moves upwardly taking lower end 184 out of grooves 186. At that point, the rotational lock between the packer assembly 14 and the components above is completely defeated. As rotational lock moves upwardly, retaining ring 174 comes into alignment with groove 176 in effect locking rotational lock 168 in the position shown in FIG. 3. At this point, a twisting force can be applied to top sub 18 to the right, which will disengage left-hand thread 202.

A hydraulic release is also possible by applying annular pressure outside the apparatus A which freely communicates with variable volume chamber 280. With the packer assembly 14 set and annular pressure applied to variable volume cavity 280, an imbalance occurs on unbalanced piston 204. An optional shear pin 206 ultimately breaks as the uphole pressure from the annulus applied to lower end 218 of unbalanced piston 204 exceeds the downhole pressure on unbalanced 204 through port 208 sending unbalanced piston 204 moving upwardly. However, before the unbalanced piston 204 can move upwardly, the lock of locking collet 196 extending into recess 226 must be defeated. This occurs as rotational lock 168 shifts upwardly moving surface 224 away from locking collets 196 and presenting surface 228 opposite locking collet 196, as shown in FIG. 3. Once this occurs, the locking collet 196 is free to move longitudinally, as seen by comparing its position in FIG. 3 to FIG. 4. Simultaneously or thereafter, the unbalanced forces on piston 204 move it uphole, as shown by comparing FIGS. 3 and 4. Piston 204 essentially becomes unlocked as the locking collet 196 is itself liberated to come out of groove 226. With the piston 204 fully shifted, collet fingers 200 become unsupported, as shown in FIG. 4. At that point, an upward pull from the surface can disengage left-hand thread 202, as the portion of the thread on collet fingers 200 merely ride over the mating thread on the packer assembly 14. At this point, the release procedure is concluded.

It should be noted that a hydraulic release is not possible by applying pressure in flowpath 56. The only way application of pressure can result in release of the packer assembly 14 is if the pressure is applied to the annulus with packer 14 set. Therefore, during the initial run-in procedure, hydraulic pressure can be applied either through the central flowpath 56 or outside the apparatus A in the annulus and the packer assembly 14 will not release. This is because the locking collets 196 prevent longitudinal disengagement. At the same time, the lower ends 184, when inserted into grooves 186 prevent relative rotation between the assembly above packer assembly 14 and packer assembly 14. Accordingly, a release of the packer assembly 14 due to a twisting force applied from the surface is also prevented by virtue of the lower end 184 of rotational lock 168 being in position in grooves 186. As it is set up the rotational lock 168 is trapped by virtue of locking keys 144 extending into recess 180. Since the locking keys 144 themselves cannot be liberated until piston 20 is shifted, it can readily been seen that since piston 20 is in pressure balance, no application of hydraulic force in flowpath 56 or in the annulus outside the apparatus A can actuate the piston 20 to move. Similarly, a twisting force applied from the surface during the run-in position will also be ineffective to release the packer assembly 14 or to set the packer assembly 14 in the wellbore.

At times it may be desirable to perform what is known in the art as a "squeeze job." This occurs when fluid is forced under pressure into the formation for a variety of purposes. In order to accomplish this, especially in using the crossover sub C, a let down force can be applied to top sub 18 which in effect blocks the flow illustrated by arrows 274 in FIG. 7 at the exit point from housing 240. In essence, the flow can proceed down through port 262 with then the only outlet being into the formation since ball 98 blocks bore 244 and the set down force on top sub 18 has in effect blocked the exit from bores 272. The apparatus of the present invention allows for such positioning which in turn has the effect of blocking the outlets of bores 272 further uphole by closing them off when they are retracted into packer assembly 14 in a manner well known in the art.

The apparatus of the present invention provides a rotational lock, which allows retention of a packer assembly 14 without fear of inadvertent disconnection or setting of the packer assembly 14. Further, a hydraulic lock is also provided. This allows use of pressure to clear debris without fear of disconnection from the packer assembly 14 or setting the packer assembly 14. The apparatus A provides for control over the timing of the setting and/or release of the packer assembly 14. Additionally, improvements have been made to a crossover assembly which allows retention of the ability to deposit gravel without fear of loss of seal due to lack of sealing pressure differential. Additionally, one of the preferred embodiments illustrated simplifies the procedure by allowing systematic reuse of a sealing mechanism to accomplish different movements of the apparatus A instead of having to sequentially position auxiliary sealing members from the surface. In the preferred embodiment, the ball 98 is reused by pushing it through seat 84 only to catch it again on seat 260 and thereafter retain it against floating away. Even with a crossover sub C circulation or reverse circulation to the bottom of the liner to remove debris is possible prior to initiating shifting of the crossover sub C into the crossover position without fear of setting the packer assembly 14 or releasing it prematurely.

The foregoing disclosure and description of the invention are illustrative and explanatory thereof, and various changes in the size, shape and materials, as well as in the details of the illustrated construction, may be made without departing from the spirit of the invention.

What is claimed is:

1. An apparatus for running in a downhole tool, comprising:

supporting means for supporting the tool from the surface at the desired depth;

lock means on said supporting means for selectively preventing release of the tool from said support means and actuation of said tool during run-in, said lock means retaining its locking function despite application of mechanical force to said support means or the tool or the application of fluid pressure within support means.

2. The apparatus of claim 1, further comprising:

a setting mechanism for the tool mounted to said supporting means, said setting mechanism mounted in pressure balance to said supporting means in a run-in position so as to be able to hold its run-in position in the face of applied downhole fluid force or mechanical force applied to said support means.

3. The apparatus of claim 2, further comprising:

unbalancing means selectively operable on said supporting means to make said setting mechanism responsive to fluid force for setting the tool.

4. The apparatus of claim 3, further comprising:

a pressure-balanced piston on said setting mechanism, said piston displacing a volume upon actuation upon selective operation of said unbalancing means and the application of fluid force;

compensation means on said supporting means to allow an alternative outlet for said displaced volume to prevent fluid lock of said pressure-balanced piston.

5. The apparatus of claim 1, wherein said lock means further comprises:

interengaging means on said support means extending selectively into the tool, said interengaging means preventing relative rotation between the tool and said support means;

said interengaging means selectively physically locked into extension into the tool.

6. The application of claim 5, wherein:

said supporting means further comprises:

a setting mechanism selectively engageable into a set position from a run-in position for operation of the tool;

said setting mechanism, when in said run-in position, securing said interengaging means in said locked position extending into the tool.

7. The apparatus of claim 1, wherein:

said support means is formed having an engagement member to selectively retain the tool;

said engagement member having selective radial flexibility;

said support means further comprising a movable backing member movable selectively with respect to said engagement member to facilitate selective release of the tool from said support means due to said radial flexibility.

8. An apparatus for running in a downhole tool, comprising:

supporting means for supporting the tool from the surface at the desired depth;

said supporting means comprises a tubular housing having a flowpath therethrough and a lower end;

said tubular housing defining an annular space in said well;

lock means on said supporting means for selectively preventing release of the tool from said support means or actuation of said tool, said lock means retaining its locking function despite application of mechanical or fluid force to said support means or the tool;

a setting mechanism for the tool mounted to said supporting means, said setting mechanism mounted in pressure balance to said supporting means in a run-in position so as to be able to hold its run-in position in the face of applied downhole fluid force or mechanical force applied to said support means;

unbalancing means selectively operable on said supporting means to make said setting mechanism responsive to fluid force for setting the tool;

said unbalancing means comprises an obstruction selectivelv actuated to block said flowpath;

a pressure-balanced piston on said setting mechanism, said piston displacing a volume upon actuation upon selective operation of said unbalancing means and the application of fluid force;

said pressure-balanced piston sealingly and slidably mounted to said housing and in flow communication with said flowpath on both sides of said obstruction:

compensation means on said supporting means to allow an alternative outlet for said displaced volume to prevent fluid lock of said pressure-balanced piston;

said volume displaced by movement of said pressure-balanced piston displaceable into said flowpath between said obstruction and said lower end;

said compensation means comprises a compensating piston which is urged to move to allow said pressure-balanced piston to displace the volume into said annular space instead of into said flowpath should said flowpath be blocked between said selectively actuated obstruction and the lower end of said flowpath.

9. The apparatus of claim 8, wherein:

said compensating piston is initially locked against movement with respect to said tubular housing;

said pressure-balanced piston unlocking said compensating piston as a result of movement of said pressure-balanced piston.

10. An apparatus for running in a downhole tool, comprising:

supporting means for supporting the tool from the surface at the desired depth;

said supporting means comprises a tubular housing having a flowpath extending therethrough and defining an annular space downhole;

said supporting means further comprises:

a setting mechanism selectively engageable into a set position from a run-in position for operation of the tool;

said setting mechanism is in pressure balance in said run-in position;

lock means on said supporting means for selectively preventing release of the tool from said support means or actuation of said tool, said lock means retaining its locking function despite application of mechanical or fluid force to said support means or the tool, said lock means further comprising interengaging means on said support means extending selectively into the tool, said interengaging means preventing relative rotation between the tool and said support means;

said interengaging means selectively physically locked into extension into the tool;

said setting mechanism, when in said run-in position, securing said interengaging means in said locked position extending into the tool;

whereupon application of a fluid force in said flowpath or said annular space alone will not urge said setting mechanism from said run-in to said set position.

11. The apparatus of claim 10, further comprising:

means for unbalancing the pressure balance of said mechanism for selective actuation of the tool, said interengaging means becoming unlocked from said tubular housing due to setting the tool.

12. The apparatus of claim 11, wherein said unbalancing means further comprises:

a first obstruction mechanism to obstruct said flowpath at a first point;

said setting mechanism further comprising a piston;

said piston having fluid communication into said flowpath on both sides of said first obstruction, whereupon a fluid force against said first obstruction urges said setting means to actuate the tool.

13. The apparatus of claim 12, further comprising:

a second obstruction mechanism at a second point in said flowpath, said second obstruction mechanism remaining inoperative until said first obstruction mechanism is defeated;

whereupon application of a fluid force on said second obstruction after its initiation urges said interengaging means, which had since been unlocked, to move out of engagement with the tool.

14. The apparatus of claim 13, wherein:

said first obstruction is a first seat in combination with a sealing element;

said first obstruction is defeated as an applied fluid force above a predetermined value forces said sealing element beyond said first seat;

said second obstruction becoming operative when said sealing element sealingly contacts a second seat disposed in said flowpath.

15. The apparatus of claim 14, wherein:

said support means is formed having an engagement member to selectively retain the tool;

said engagement member having selective radial flexibility;

said support means further comprising a movable backing member movable selectively with respect to said engagement member to facilitate selective release of the tool from said support means due to said radial flexibility.

16. The apparatus of claim 15, wherein:

said backing member is trapped in an initial position adjacent said engagement member to facilitate retention of the tool;

said interengaging means when removed from said tool releasing said backing member from its said trapped position to allow it to move.

17. The apparatus of claim 16, wherein:

said backing member is trapped in an initial position adjacent said engagement member to facilitate retention of the tool;

interengaging means on said support means extending selectively into the tool to prevent relative rotation between said support means and said tool;

said interengaging means when removed from said tool releasing said backing member from its said trapped position to allow it to move.

18. The apparatus of claim 17, wherein:

said engagement member is disengageable from the tool by rotation upon removal of said interengaging means from the tool;

said engagement member formed of at least one collet having a thread thereon to facilitate rotational disengagement from the tool.

19. The apparatus of claim 18, wherein:

said support means comprises a tubular housing having a flowpath therethrough and defining an annulus in the wellbore;

said backing member sealingly exposed on opposing sides to said flowpath and said annulus;

said backing member retaining its position after removal of said interengaging means from the tool due to a force imbalance.

20. The apparatus of claim 19, wherein:

said backing member moving in response to an applied fluid force in said annular space so as to move with respect to said engagement member so as to allow said radial flexibility to facilitate alternative disengagement between the tool and said engagement member by a longitudinal force.

21. The apparatus of claim 20, wherein:

said setting mechanism mounted in pressure balance to said supporting means in a run-in position so as to be able to hold its run-in position in the face of applied downhole fluid force or mechanical force applied to said support means.

22. The apparatus of claim 21, further comprising:

a pressure-balanced piston on said setting mechanism, said piston displacing a volume upon actuation upon selective operation of said unbalancing means and the application of fluid force;

compensation means on said supporting means to allow an alternative outlet for said displaced volume to prevent fluid lock of said pressure-balanced piston.

23. The apparatus of claim 22, wherein:

said pressure-balanced piston sealingly and slidably mounted to said housing and in flow communication with said flowpath on both sides of said obstruction;

said volume displaced by movement of said pressure-balanced piston displaceable into said flowpath between said obstruction and said lower end;

said compensation means comprises a compensating piston which is urged to move to allow said pressure-balanced piston to displace the volume into said annular space instead of into said flowpath should said flowpath be blocked between said selectively actuated obstruction and the lower end of said flowpath.

24. The apparatus of claim 23, wherein:

said compensating piston is initially locked against movement with respect to said tubular housing;

said pressure-balanced piston unlocking said compensating piston as a result of movement of said pressure-balanced piston.

25. An apparatus for running in a downhole tool, comprising:

supporting means for supporting the tool from the surface at the desired depth;

lock means on said supporting means for selectively preventing release of the tool from said support means or actuation of said tool, said lock means retaining its locking function despite application of mechanical or fluid force to said support means or the tool;

said support means is formed having an engagement member to selectively retain the tool;

said engagement member having selective radial flexibility;

said support means further comprising a movable backing member movable selectively with respect to said engagement member to facilitate selective release of the tool from said support means due to said radial flexibility;

said backing member is trapped in an initial position adjacent said engagement member to facilitate retention of the tool;

interengaging means on said support means extending selectively into the tool to prevent relative rotation between said support means and said tool;

said interengaging means when removed from said tool releasing said backing member from its said trapped position to allow it to move.

26. The apparatus of claim 25, wherein:

said engagement member is disengageable from the tool by rotation upon removal of said interengaging means from the tool;

said engagement member formed of at least one collet having a thread thereon to facilitate rotational disengagement from the tool.

27. The apparatus of claim 26, wherein:

said support means comprises a tubular housing having a flowpath therethrough and defining an annulus in the wellbore;

said backing member sealingly exposed on opposing sides to said flowpath and said annulus;

said backing member retaining its position after removal of said interengaging means from the tool due to a force imbalance.

28. The apparatus of claim 27, wherein:

said backing member moving in response to an applied fluid force in said annular space so as to move with respect to said engagement member so as to allow said radial flexibility to facilitate alternative disengagement between the tool and said engagement member by a longitudinal force.

29. A method of placement of a downhole tool, comprising the steps of:

running the tool into the well on a tubing string;

preventing release and actuation of the tool from the tubing string during said running stop responsive to mechanical forces applied through said string or fluid forces applied through or outside of said tubing string in the wellbore.

30. The method of claim 29, further comprising the steps of:

providing an initial pressure balance on the actuation mechanism for the tool;

upsetting said pressure balance from the surface;

setting the tool.

31. A method of placement of a downhole tool, comprising the steps of:

running the tool into the well on a tubing string;

initially locking rotationally the tubing string to the tool with a locking mechanism;

preventing release or actuation of the tool from the tubing string responsive to mechanical forces applied through said string or fluid forces applied through or outside of said tubing string in the wellbore;

providing an initial pressure balance on the actuation mechanism for the tool;

upsetting said pressure balance from the surface;

setting the tool;

unlocking rotationally said tubing string from the tool, resulting from said setting;

applying a force to the locking mechanism;

forcing said locking mechanism to disengage the tool;

disengaging said tubing string from said tool by rotation.

32. The method of claim 31, further comprising the steps of:

connecting the tubing string to the tool with at least one collet;

supporting, at least temporarily, said collet into engagement with said tool using a piston;

selectively applying a force to said piston;

moving the piston;

undermining the support for said collet;

alternatively disengaging said string from the tool with a pulling force.

33. An apparatus for running in a downhole tool, comprising:

support means for supporting the tool from the surface at the desired depth;

a setting mechanism on said support means for selectively actuating said tool, further comprising:

a piston said piston movably mounted to actuate the tool;

movable compensating means on said support means, said compensating means movable by virtue of fluid force developed by movement of said piston, to provide an additional avenue of fluid displacement created by forces applied to said piston, when at least a portion of said support means is obstructed in a manner which would otherwise allow movement of said piston.

34. The apparatus of claim 33, further comprising:

a first lock mechanism on said support means for selectively rotationally locking the tool to the support means such that rotational forces applied to said support means will not result in release of the tool.

35. The apparatus of claim 34, wherein:

said first lock mechanism is defeated by selective actuation of said setting mechanism which sets the tool.

36. An apparatus for running in a downhole tool, comprising:

support means for supporting the tool from the surface at the desired depth;

a setting mechanism on said support means for selectively actuating said tool, further comprising:

a piston;

compensating means on said support means, operable in conjunction with said piston, to provide an alternative avenue of fluid displacement created by forces applied to said piston, when at least a portion of said support means is obstructed in a manner which would otherwise allow movement of said piston;

said support means comprises a tubing string;

said piston is pressure-balanced;

said piston is actuable by obstruction of said tubing string;

said piston displacing a volume due to movement which is directed around said obstruction and into said tubing string;

said compensating means allowing volume displaced by said piston to go through said support means into the wellbore when said support means below said obstruction is for any reason further obstructed.

37. An apparatus for running in a downhole tool, comprising:

support means for supporting the tool from the surface at the desired depth;

a setting mechanism on said support means for selectively actuating said tool, further comprising:

a piston;

compensating means on said support means, operable in conjunction with said piston, to provide an alternative avenue of fluid displacement created by forces applied to said piston, when at least a portion of said support means is obstructed in a manner which would otherwise allow movement of said piston;

a first lock mechanism on said support means for selectively rotationally locking the tool to the support means such that rotational forces applied to said support means will not result in release of the tool;

said first lock mechanism is defeated by selective actuation of said setting mechanism which sets the tool;

said movement of said piston slides a sleeve connected to said piston;

said sleeve trapping said first lock mechanism in a manner where it extends into said tool to prevent relative rotation with respect to said support means;

whereupon actuation of said piston said sleeve shifts, allowing an applied force to said first lock mechanism to retract said first lock mechanism out of the tool for facilitating release of the tool by rotation of said support means.

38. An apparatus for running in a downhole tool, comprising:

support means for supporting the tool from the surface at the desired depth;

a setting mechanism on said support means for selectively actuating said tool, further comprising:

a piston;

compensating means on said support means, operable in conjunction with said piston, to provide an alternative avenue of fluid displacement created by forces applied to said piston, when at least a portion of said support means is obstructed in a manner which would otherwise allow movement of said piston;

a first lock mechanism on said support means for selectively rotationally locking the tool to the support means such that rotational forces applied to said support means will not result in release of the tool;

a second lock mechanism on said support means for selectively securing against release of the tool from said support means due to longitudinal forces applied to said support means.

39. The apparatus of claim 38, wherein:

said support means further comprises:

at least one collet, said collet selectively securing the tool;

a collet support selectively movable with respect to said collet;

whereupon movement of said collet support said selective securing of said support means can be undermined, allowing a longitudinal force to separate said support means from the tool.

40. The apparatus of claim 39, wherein:

said collet support further comprises an unbalanced piston;

said unbalanced piston selectively locked against movement by said first lock mechanism, whereupon actuation of said first lock mechanism to permit relative rotation between said support means and said tool, said unbalanced piston is unlocked so that it is capable of moving for selective release of the tool by removal of support for said collet.

41. The apparatus of claim 40, wherein:

said unbalanced piston is actuable by an applied fluid force from outside said support means;

said collet has an external thread engageable to the tool;

said tool disengageable by rotation to undo said thread on said collet after defeat of said first lock mechanism;

said tool additionally disengageable by longitudinal force applied to said support means when said second lock mechanism is defeated, allowing said thread to disengage without rotation.

42. An apparatus for running in a downhole tool, comprising:

support means for supporting the tool from the surface at the desired depth;

a first lock mechanism on said support means for selectively rotationally locking the tool to the support means such that rotational forces applied to said support means will not result in release of the tool;

a second lock mechanism on said support means for selectively securing against release of the tool from said support means due to longitudinal forces applied to said support means.

43. The apparatus of claim 42, wherein:

said support means further comprises:

at least one collet, said collet selectively securing the tool;

a collet support selectively movable with respect to said collet;

whereupon movement of said collet support said selective securing of said support means can be undermined, allowing a longitudinal force to separate said support means from the tool.

44. The apparatus of claim 43, wherein:

said collet support further comprises an unbalanced piston;

said unbalanced piston selectively locked against movement by said first lock mechanism, whereupon actuation of said first lock mechanism to permit relative rotation between said support means and said tool, said unbalanced piston is unlocked so that it is capable of moving for selective release of the tool by removal of support for said collet.

45. An apparatus for running in a downhole tool, comprising:

support means for supporting the tool from the surface at the desired depth;

a first lock mechanism on said support means for selectively securing against release of the tool from said support means due to longitudinal forces applied to said support means;

said support means further comprises:

at least one collet, said collet selectively securing the tool;

a collet support selectively movable with respect to said collet;

whereupon movement of said collet support, said selective securing of said support means can be undermined, allowing a longitudinal force to separate said support means from the tool;

a setting mechanism on said support means for selectively actuating said tool, further comprising:

a piston;

compensating means on said support means, operable in conjunction with said piston, to provide an alternative avenue of fluid displacement created by forces applied to said piston, when at least a portion of said support means is obstructed in a manner which would otherwise allow movement of said piston.

46. The apparatus of claim 45, wherein:

said support means comprises a tubing string;

said piston is pressure-balanced;

said piston is actuable by obstruction of said tubing string;

said piston displacing a volume due to movement which is directed around said obstruction and into said tubing string;

said compensating means allowing volume displaced by said piston to go through said support means into the wellbore when said support means below said obstruction is for any reason further obstructed.

47. The apparatus of claim 46, further comprising:

a second lock mechanism on said support means for selectively rotationally locking the tool to the support means such that rotational forces applied to said support means will not result in release of the tool;

said collet support further comprises an unbalanced piston;

said unbalanced piston selectively locked against movement by said first lock mechanism, whereupon actuation of said first lock mechanism to permit relative rotation between said support means and said tool, said unbalanced piston is unlocked so that it is capable of moving for selective release of the tool by removal of support for said collet.

48. The apparatus of claim 47, wherein:

said unbalanced piston is actuable by an applied fluid force from outside said support means;

said collet has an external thread engageable to the tool;

said tool disengageable by rotation to undo said thread on said collet after defeat of said second lock mechanism;

said tool additionally disengageable by longitudinal force applied to said support means when said first lock mechanism is defeated, allowing said thread to disengage without rotation.

* * * * *

UNITED STATES PATENT AND TRADEMARK OFFICE

CERTIFICATE OF CORRECTION

PATENT NO. : 5,360,069
DATED : November 1, 1994
INVENTOR(S) : Phillip W. Schmuck et al.

It is certified that error appears in the above-identified patent and that said Letters Patent is hereby corrected as shown below:

In the Abstract, at line 5, please insert -- not -- between the words "will" and "actuate".

In the Abstract, at line 14, please insert -- of -- between the words "removal" and "debris".

At column 3, lines 16–17, please delete "convening" and insert --converting -- therefor.

At column 4, line 17, please delete "26" and insert -- 24 -- therefor.

At column 4, line 18, please delete "26" and insert -- 24 -- therefor.

Signed and Sealed this

Eighteenth Day of April, 1995

Bruce Lehman

*Attest:*

BRUCE LEHMAN

*Commissioner of Patents and Trademarks*

*Attesting Officer*